US008855351B2

(12) United States Patent
Alstad

(10) Patent No.: US 8,855,351 B2
(45) **Date of Patent: *Oct. 7, 2014**

(54) EAR PHONE LISTENING DEVICE

(76) Inventor: Shawn R. Alstad, Peoria, AZ (US)

( * ) Notice: Subject to any disclaimer, the term of this patent is extended or adjusted under 35 U.S.C. 154(b) by 63 days.

This patent is subject to a terminal disclaimer.

(21) Appl. No.: 13/607,149

(22) Filed: Sep. 7, 2012

(65) Prior Publication Data

US 2013/0064412 A1 Mar. 14, 2013

Related U.S. Application Data

(62) Division of application No. 13/607,181, filed on Sep. 7, 2012, and a division of application No. 13/607,206, filed on Sep. 7, 2012.

(60) Provisional application No. 61/533,274, filed on Sep. 12, 2011.

(51) Int. Cl.
*H04R 25/00* (2006.01)
*H04R 1/10* (2006.01)

(52) U.S. Cl.
CPC ..... *H04R 1/1033* (2013.01)
USPC ..... 381/376; 381/367

(58) Field of Classification Search
USPC ..... 381/367, 376
See application file for complete search history.

(56) References Cited

U.S. PATENT DOCUMENTS

| | | | | |
|---|---|---|---|---|
| 5,317,643 | A * | 5/1994 | Patricelli | 381/376 |
| 5,881,160 | A * | 3/1999 | Sheppard | 381/376 |
| 8,213,670 | B2 * | 7/2012 | Lai | 381/388 |
| 8,503,711 | B2 | 8/2013 | Flynn | |

* cited by examiner

*Primary Examiner* — Davetta W Goins
*Assistant Examiner* — Amir Etesam
(74) *Attorney, Agent, or Firm* — Griffiths & Seaton PLLC

(57) ABSTRACT

An earphone plug for receiving sound signals, having a first headphone cord connected to the earphone plug having a first length, and a second headphone cord connected to the earphone plug having a second length is provided. A first earphone body connected to the first headphone cord is provided for converting the sound signals to audible sounds. A second earphone body, connected to the second headphone cord, is provided for converting the sound signals to audible sounds. An attachment mechanism coupled to at least a portion of the first headphone cord or the second headphone cord for securing the earphone to an article of clothing.

20 Claims, 28 Drawing Sheets

EAR PHONE LISTENING DEVICE

CROSS-REFERENCE TO RELATED APPLICATIONS

This non-provisional application claims the benefit under 35 U.S.C. §119(e) to U.S. Provisional Application No. 61/533,274, filed Sep. 12, 2011, which is incorporated herein in its entirety. Moreover, this application is a divisional application of copending U.S. application Ser. Nos. 13/607,181 and 13/607,206, filed on Sep. 7, 2012, the entire contents of which are incorporated herein by reference and are relied upon for claiming the benefit of priority.

BACKGROUND OF THE INVENTION

1. Field of the Invention

The present invention relates in general to a container listening device aid, and more particularly to an ear phone listening device.

2. Description of the Related Art

Today's society has become music oriented with the availability of music more convenient than in recent years. Many devices allow people to listen to music nearly everywhere. However, currently limitations arise for those persons wearing certain articles of clothing, for example a helmet or hat, to easily and safely listen to music. A need exists for a safe and durable listening device to provide music on demand while wearing certain articles of clothing.

SUMMARY OF THE DESCRIBED EMBODIMENTS

In the past, many music listeners carry a variety of media devices that provide music within coats, shirts, and/or jackets while performing a variety of activities, such as running, riding a bicycle, and or riding motorcycles and/or snowmobiles. A problem experienced by a music listener wearing an article of clothing on the head, such as a helmet or hat, is that when the music listener puts the helmet/hat on and/or takes the helmet off, the headphones attached to a media device fall out, or worse yet, one of the headphones falls out of the ear as soon as any type of motion commences. Then, if the music listener needs to start, stop, pause, change volume, an/or change a track, it is nearly impossible and dangerous when attempting such actions with hand gloves on. Added further danger and difficulty, is a music listener may have speaker wires running from their body up past their neck into the article of clothing covering the head (e.g., the helmet or hat).

Accordingly, various apparatus and method of manufacturing embodiments for a listening device aid are provided. In one embodiment, by way of example only, an earphone plug for receiving sound signals, having a first headphone cord connected to the earphone plug having a first length and a second headphone cord connected to the earphone plug having a second length is provided. A first earphone body connected to the first headphone cord is provided for converting the sound signals to audible sounds. A second earphone body, connected to the second headphone cord, is provided for converting the sound signals to audible sounds. An attachment mechanism coupled to at least a portion of the first headphone cord or the second headphone cord for securing the earphone to an article of clothing.

In addition to the foregoing exemplary apparatus embodiment, other exemplary method of manufacturing and apparatus embodiments are provided and supply related advantages. The foregoing summary has been provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict embodiments of the invention and are not therefore to be considered to be limiting of its scope, the invention will be described and explained with additional specificity and detail through the use of the accompanying drawings, in which.

DETAILED DESCRIPTION OF THE DRAWINGS

Figure 1:
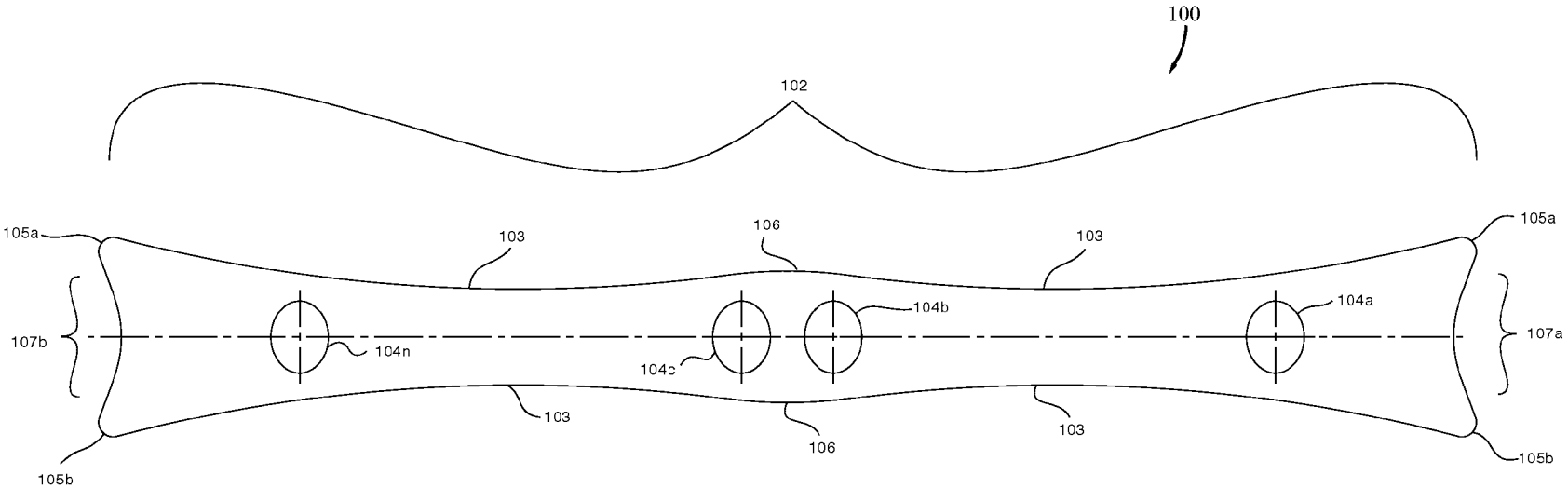
FIG. 1 is a diagram illustrating an exemplary flexible strap device in which aspects of the present invention may be realized.

As mentioned above, many music listeners carry a variety of media devices that provide music within coats, shirts, and/or jackets while performing a variety of activities, such as running, riding a bicycle, and or riding motorcycles and/or snowmobiles. A problem experienced by a music listener wearing an article of clothing on the head, such as a helmet or hat, is that when the music listener puts the helmet/hat on and/or takes the helmet off, the headphones attached to a media device fall out, or worse yet, one of the headphones falls out of the ear as soon as any type of motion commences.

In contrast, and to address the inefficiencies previously described, the present invention seeks to allow various headphones and any input audio device, such as a mini MP3 player, to be mounted to or inside various articles of clothing, such as headwear or headgear, thereby allowing the user to listen to the audio contained on the audio device while wearing the various types of articles of clothing for the head, such as a helmet, hat, and headwear/headgear.

Accordingly, various apparatus and method of manufacturing embodiments for a listening device aid are provided. In one embodiment, by way of example only, An earphone plug for receiving sound signals, having a first headphone cord connected to the earphone plug having a first length and a second headphone cord connected to the earphone plug having a second length is provided. A first earphone body connected to the first headphone cord is provided for converting the sound signals to audible sounds. A second earphone body, connected to the second headphone cord, is provided for converting the sound signals to audible sounds. A flexible strap, having a portion thereof in communication with one of at least a portion of the first headphone cord and the second headphone cord is also provided. The flexible strap is secured to the article of clothing for wearing the first headphone cord, the second headphone cord, and the earphone plug in combination with the article of clothing.

As illustrated below, the benefits of the present invention include, but are not limited to mounting "over the ear" headphones inside larger headgear such as helmets, which ensures the headphones stay in place while putting helmet on or taking it off. In-ear headphones may be used for headgear and/or headwear that do not contain ear protection while still using a Mini MP3 player that may be mounted to the various styles of headgear and/or headwear, regardless if the headgear and/or headwear have a visor. Because the in-ear headphones are the lowest point of the complete audio system, gravity does not try to pull them out of the user's ears. Also, many media device players are small enough so as to be mounted to the headgear and/or headwear (e.g., a helmet). In one embodiment, once the electrical wire/headphone cord is secured, then the entire system is now completely contained on or to the headgear and/or headwear. Thus, the present invention thereby eliminates the need for a user to carry a media device player on the person's body, while having the connecting wires running up past the user's neck to the headphones. Moreover, because the media device (such as a mini MP3 player) may be mounted externally, it is very easily accessible to start/stop/change volume or change channels even with gloves on. The listening device aid allows various headphones and any media device (e.g., a mini MP3 player) to be mounted externally and/or internally to various headwear and/or headgear thereby allowing the user to listen to the audio contained on the media device.

Turning now to FIG. 1, a diagram illustrating an exemplary flexible strap device 100 is depicted. In FIG. 1, the flexible strap 102 may be of a variety of lengths, shapes and sizes based on the various articles of clothing that would be worn on the head requires. The flexible strap 102 may be straight, curved, angled, and/or formed to a variety of geometric shapes or positions for being secured and/or hidden within the various articles of clothing that would be worn on the head (e.g. a baseball hat, helmet, wig, and/or visor). For example, right and/or left portions 103 along the sides (which are illustrated in FIG. 1 by combining 103 and 106 to the sides of the flexible strap 102) of the flexible strap 102 may be concave, convex, or other geometric shapes (shown in the FIG. 1 with an elongated elliptical shape) and the center portion 106 may also be concave or convex (shown in FIG. 1 as convex). The thickness, depth, and/or width of the flexible strap may vary according to the type of article of clothing. For example, in a baseball type hat the flexible strap 102 may be relatively thin (e.g., less than a millimeter in thickness) or for a motorcycle helmet the flexible strap 102 may be designed with a thicker dimension (e.g., 3 millimeters) for more stability and strength. However, the thickness may also be based upon user preferences and vary accordingly. The flexible strap 102 may be comprised of a variety of materials, such as a plastic substance, carbon fibers, polyurethane material, synthetic polymer material, cushioning material, fibrous materials, rubber materials, glass, elastic materials, flexible materials (e.g., a flexible membrane), cork, foam, metallic materials and/or other material or combination of materials known in the art, which are suitable for such an application. The flexible strap 102 may have an adhesive type material applied to any portion thereon and the adhesive material may include, but not limited to, tape, glue, buttons, clips, suction cups, pins, Velcro®, a heat seal, reactive/non-reactive and/or natural synthetic type adhesives, and/or any type of substance known in the art that unites, bonds, secures, fastens, pins, tacks, and/or sticks to the article of clothing or protective device for the head. For example, the flexible strap 102 may have a sticky, glue like substance that is applied to an one side of the flexible strap for sticking the flexible strap 102 to a helmet (not shown). The flexible strap 102 has an ending 107 that forms a right foot 105 and a left foot 105. The end portion 107 (shown as 107*a* for the right foot and 107*b* for the left foot) of each of the right foot 105 and the left foot 105 may be concave thereby having the end points 107 of the right foot 105 and the left foot 105 extends to a sharp point. FIG. 1 illustrates the right foot 105 having the concave end thereby creating a top point 105*a* of the foot and a bottom point 105*b* of the foot. Similarly, FIG. 1 illustrates the left foot 105 having the concave ending 107 thereby creating a top point 105*a* of the foot and a bottom point 105*b* of the foot. Both the right foot 105 and the left foot 105 may be manipulated within an article of clothing for securing, hiding, providing stability and support, and/or attaching the flexible strip to the article of clothing (e.g., a baseball cap, helmet, and/or visor). The right foot 105 and the left foot 105 of the flexible strap 102 operate as a stabilizing foot and/or end piece for placement in an exterior or interior structure of the article of clothing designed for headwear (e.g., a baseball hat or helmet).

Moreover, the flexible strap 102 also contains a number of openings 104 (e.g., holes and the holes are labeled in FIG. 1 as 104*a-n*) for allowing an earphone/headphone cord to be routed through the flexible strap 102. The openings 104 may be of a variety of diameters and sizes based on the size and width of the flexible strap 102 and may be positioned in a variety of locations along the flexible strap 102. For example, as illustrated in FIG. 1, openings 104*a* and 104*n* may be placed at both ends 107*a* and 107*b* of the flexible strap 102 and then two openings 104*c* and 104*b* may be position adjacent to each other in the center portion 106, having the elongated elliptical shape, of the flexible strap 102.

Figure 2:
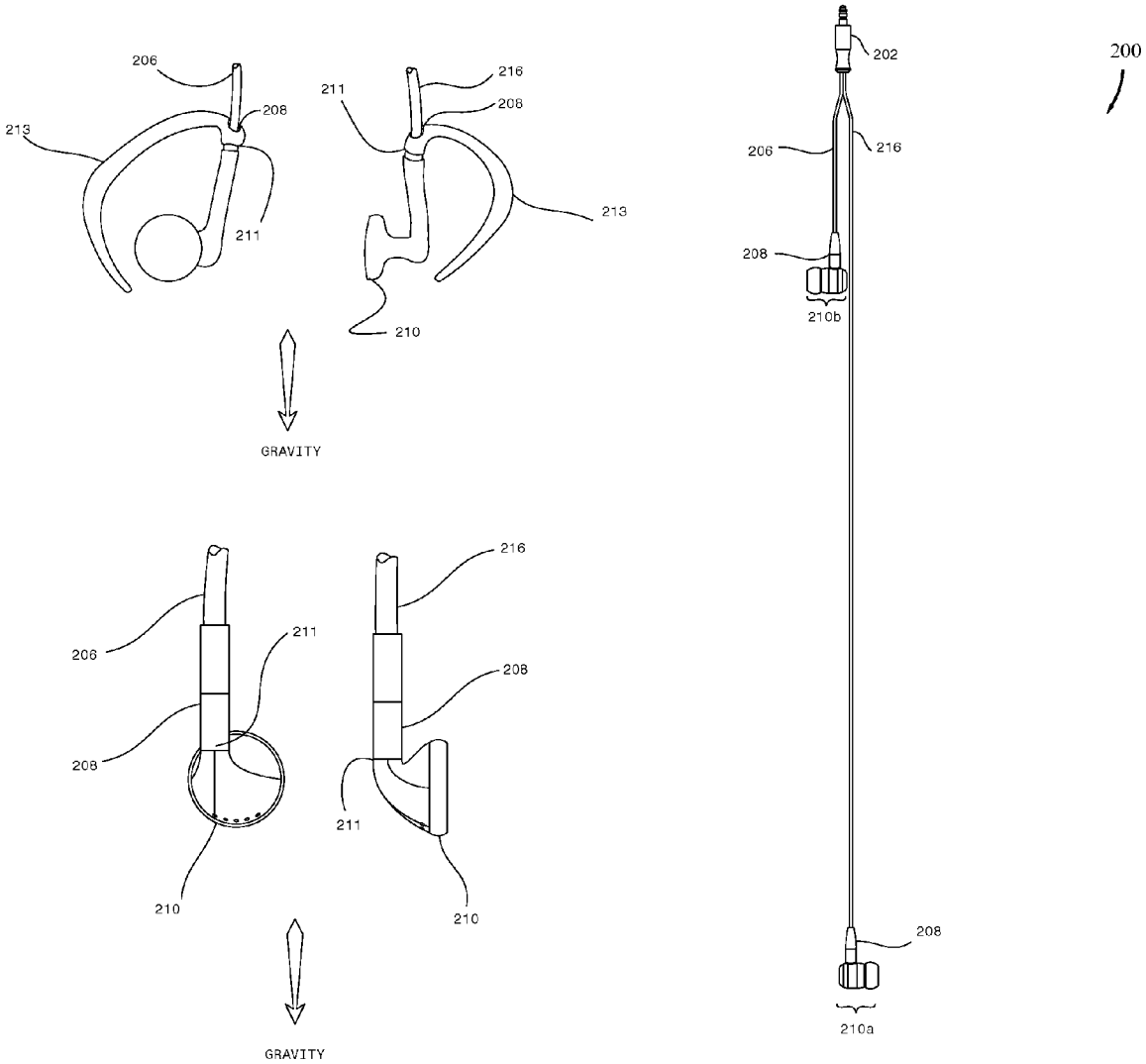
FIG. 2 is a diagram illustrating an exemplary earphone device which aspects of the present invention may be realized.

FIG. 2 is a diagram illustrating an exemplary earphone device 200 in which aspects of the present invention may be realized. The earphone device 200 comprising an earphone plug 202 capable of being inserted into media device (not shown) for receiving sound signals. A first headphone cord 216 having a first length is connected to the earphone plug 202. A second headphone cord 206, having a second length, is connected to the earphone plug 202. The length of the first headphone cord 216 is greater than the length of the second headphone cord 206. The length of both the first headphone cord 216 and the second headphone cord 206 may be of a variety of lengths based on a users preference and the type of article of clothing. However, despite the variable length options, the length of the first headphone cord 216 remains greater than the length of the second headphone cord 206. For example, if the article of clothing is a helmet the length of both the first headphone cord 206 and the second headphone cord 216 will be designed accordingly with the length of the first headphone cord 216 being greater than the length of the second headphone cord 206. Also, a first earphone body 210*a* is connected to the first headphone cord 216 for converting the sound signals to audible sounds. A second earphone body 210*b* is connected to the second headphone cord 206 for converting the sound signals to audible sounds. The first earphone body 210*a* and the second earphone body 210*b* are shaped to be retained in one of a concha cavity of a human ear and the article of clothing. The first headphone cord 216 is coupled to the first earphone body 210*a* (illustrated in FIG. 2 generically as 210 but also specifically with label 210*a*) with an attachment point 208 connected to a top portion 211 of the earphone body 210 such that the headphone body 210 is lower than the attachment point 208. In other words, the attachment point 208 (e.g., an audio input device) is located above (e.g., on the top portion 211) the first earphone body 210*a* and the second earphone body 210*b* (e.g., the earphone body 210) because of the geometry of the human ear and allows the headphones to more easily remain in the ear since the first earphone body 210*a* and the second earphone body 210*b* are at the lowest point of the earphone device 200. An attachment mechanism (e.g., a media device and not shown) or a strap for securing the attachment mechanism is coupled to at least a portion of the first headphone cord 216 or the second headphone cord 206 for securing the earphone to an article of clothing. Also, a hanging device 213 may be coupled to one of the first earphone body 210*a* and the second earphone body 210*b* for attaching and securing the first earphone body 210*a* and the second earphone body 210*b* to a user's ear.

Figure 3:
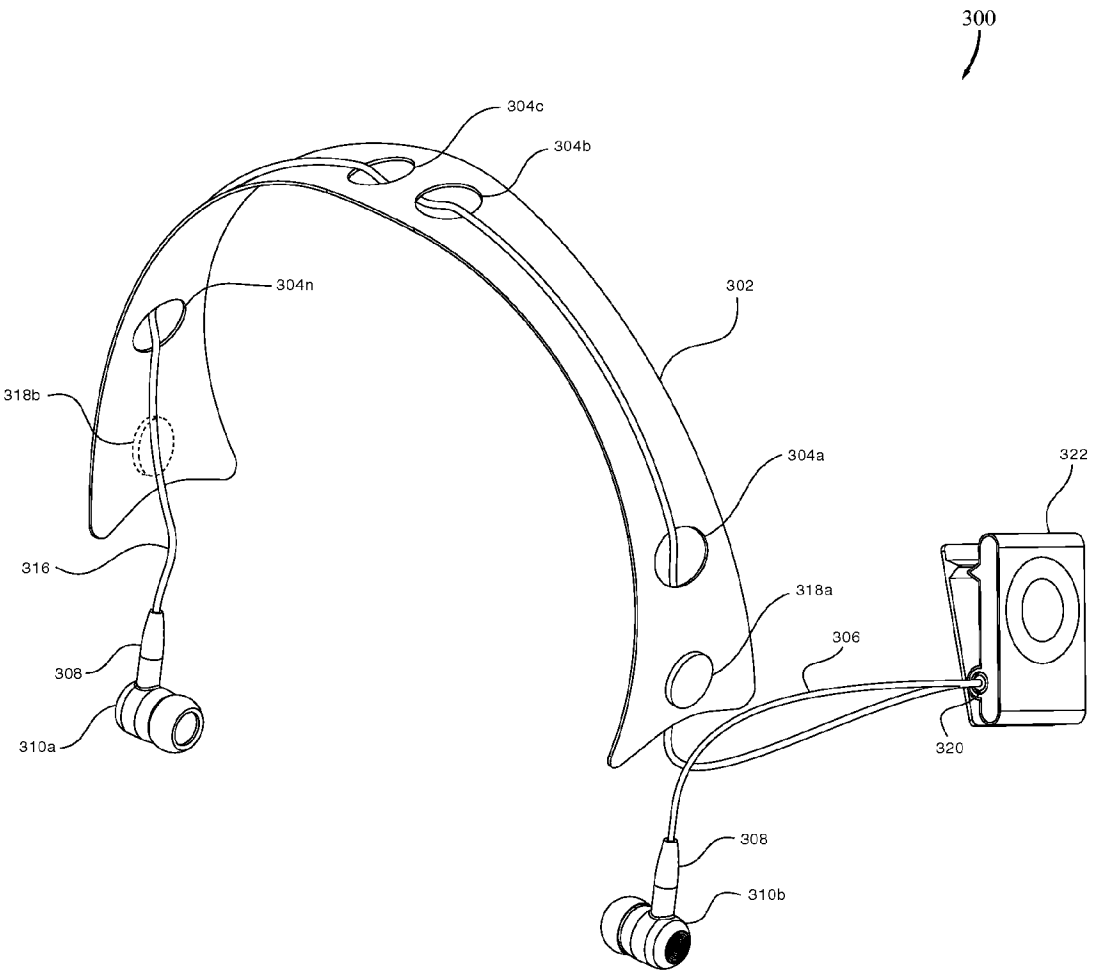
FIG. 3 is a diagram illustrating an exemplary listening device aid in which aspects of the present invention may be realized.

FIG. 3 is a diagram illustrating an exemplary listening device aid 300 in which aspects of the present invention may be realized. FIG. 3 illustrates the combination of FIG. 1 and FIG. 2 as applied to the present invention and incorporates the elements described therein and includes all of the embodiments within FIG. 1 and FIG. 2. The flexible strap 302 may be of a variety of lengths, shapes and sizes based on the various articles of clothing that would be worn on the head requires. The flexible strap 302 may be straight, curved, angled, and/or formed to a variety of geometric shapes or positions for being secured and/or hidden within the various articles of clothing that would be worn on the head (e.g. a baseball hat, helmet, wig, and/or visor). Moreover, the flexible strap 302 also contains a number of openings 304 (e.g., holes and labeled in FIG. 3 as 304*a-n*) for allowing an earphone/headphone cord to be routed through the flexible strap 302. The openings 304 may be of a variety of diameters and sizes based on the size and width of the flexible strap 102 and may be positioned in a variety of locations along the flexible strap 102. The earphone device (as shown in FIG. 2 200) illustrates the first headphone cord 316, having a first length that is connected to the earphone plug 320. A second headphone cord 306, having a second length, is also connected to the earphone plug 320. The first headphone cord 316 is routed through the flexible strap 302. As illustrated in FIG. 3, the first headphone cord 316 is routed through the openings 304 (304*a-n*) and is thereby secured to the flexible strap 302. Since the length of the first headphone cord 316 is greater than the length of the second headphone cord 306, the first headphone cord 316 is able to traverse and be routed along the flexible strap 302 to reach an ear of the user. Also, the first earphone body 310*a* is connected to the first headphone cord 316 for converting the sound signals to audible sounds. The second earphone body 310*b* is connected to the second headphone cord 306 for converting the sound signals to audible sounds. The first earphone body 310*a* and the second earphone body 310*b* are shaped to be retained in one of a concha cavity of a human ear and the article of clothing. The first headphone cord 316 is coupled to the first earphone body 310*a* with an attachment point 308 such that the headphone body 310*a* is lower than the attachment point 308. In other words, the attachment point 308 (e.g., an audio input device) is located above the first earphone body 310*a* and the second earphone body 310*b* because of the geometry of the human ear and allows the headphones to more easily remain in the ear since the first earphone body 310*a* and the second earphone body 310*b* are at the lowest point of the earphone device (FIG. 2 200). An attachment mechanism 322 (e.g., a media device) or a strap for securing the attachment mechanism is coupled to at least a portion of the first headphone cord 316 or the second headphone cord 306 for securing the earphone to an article of clothing. FIG. 3 illustrates the media device 322 (e.g., a mini MP3 player) includes a clip for securing the media device 322 to an article of clothing (e.g., a helmet, hat, and/or visor, etc.) Also, a hanging device (not shown) may be coupled to one of the first earphone body 310*a* and the second earphone body 310*b* for attaching and securing the first earphone body 210*a* and the second earphone body 210*b* to a user's ear. The flexible strap 302 also includes slots 318 (e.g., circular openings/groves and the circular openings/groves are shown in FIG. 3 as 318*a* and 318*b*) for receiving magnets. The magnets included in the slots 318 allow for the first earphone body 310*a* and the second earphone body 310*b* to be secured by the magnets when the first earphone body 310*a* and the second earphone body 310*b* are desired to be stored/secured when not in use in a person's ear.

Figure 4:
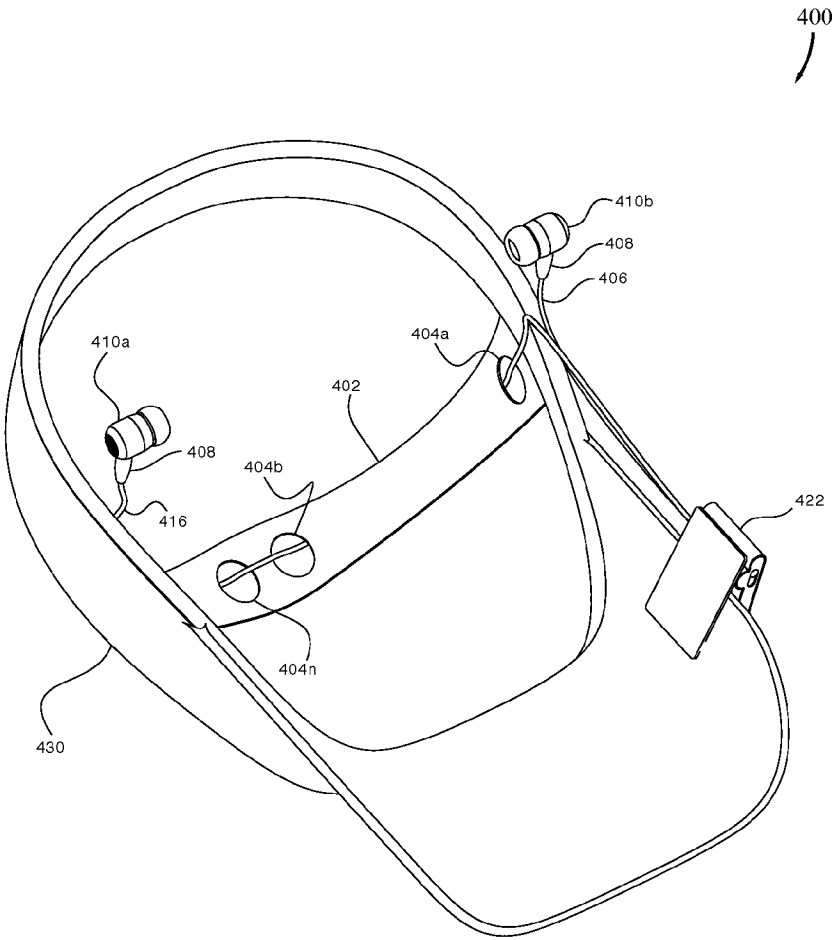
FIG. 4 is a diagram illustrating an exemplary listening device aid hidden within an article of clothing in which aspects of the present invention may be realized.

FIG. 4 is a diagram illustrating the exemplary listening device aid 400 hidden within an article of clothing. The article of clothing may be a hat, a helmet (e.g., a welding helmet, a bicycle helmet, a motorcycle helmet, etc.), a visor, a headband, a sweatband, a wig, a fedora, a bandana, a veil, a bonnet, a crown, a hood, a turban, a teirra, a head wrap, a bandana, a mask, headwear, headgear, and/or any other type of clothing or protective device that may be worn and/or placed on or around a persons head. As illustrated, the flexible strap 402 is positioned, secured, and hidden within a baseball type hat 430. The first headphone cord 416 is routed through the openings 404 (304*a-n*) and is thereby secured to the flexible strap 402 while the listening device 400 is secured within the hat 430. Since the length of the first headphone cord 416 is greater than the length of the second headphone cord 406, the first headphone cord 416 is able to traverse and be routed along the flexible strap 402. Also, the first earphone body 410*a* is connected to the first headphone cord 416 for converting the sound signals to audible sounds. The second earphone body 410*b* is connected to the second headphone cord 406 for converting the sound signals to audible sounds. The first earphone body 410*a* and the second earphone body 410*b* are shaped to be retained in one of a concha cavity of a human ear and the article of clothing. The first headphone cord 416 is coupled to the first earphone body 410*a* with an attachment point 408 such that the headphone body 410*a* is lower than the attachment point 410*a*. In other words, the attachment point 408 (e.g., an audio input device) is located above the first earphone body 410*a* and the second earphone body 410*b* because of the geometry of the human ear and allows the headphones to more easily remain in the ear since the first earphone body 410*a* and the second earphone body 410*b* are at the lowest point of the earphone device (FIG. 2 200). The attachment mechanism 422 (e.g., a media device), or a strap for securing the attachment mechanism 422, is coupled to at least a portion of the first headphone cord 416 or the second headphone cord 406 for securing the earphone to an article of clothing. FIG. 4 illustrates that a media device 422 (e.g., a mini MP3 player) includes a clip for securing the media device 422 to an article of clothing (e.g., a helmet, hat, and/or visor, etc.) The clip of the media device 422 is connected to the hat 430 to secure the media device 422. In FIG. 4, the media device 422 is connected is clipped/connected to a brim of the hat 430. As illustrated in FIG. 4, the listening device 400 may be easily installed and placed within the hat 430 with the media device 422 easily being attached to the hat 430.

Figure 5:
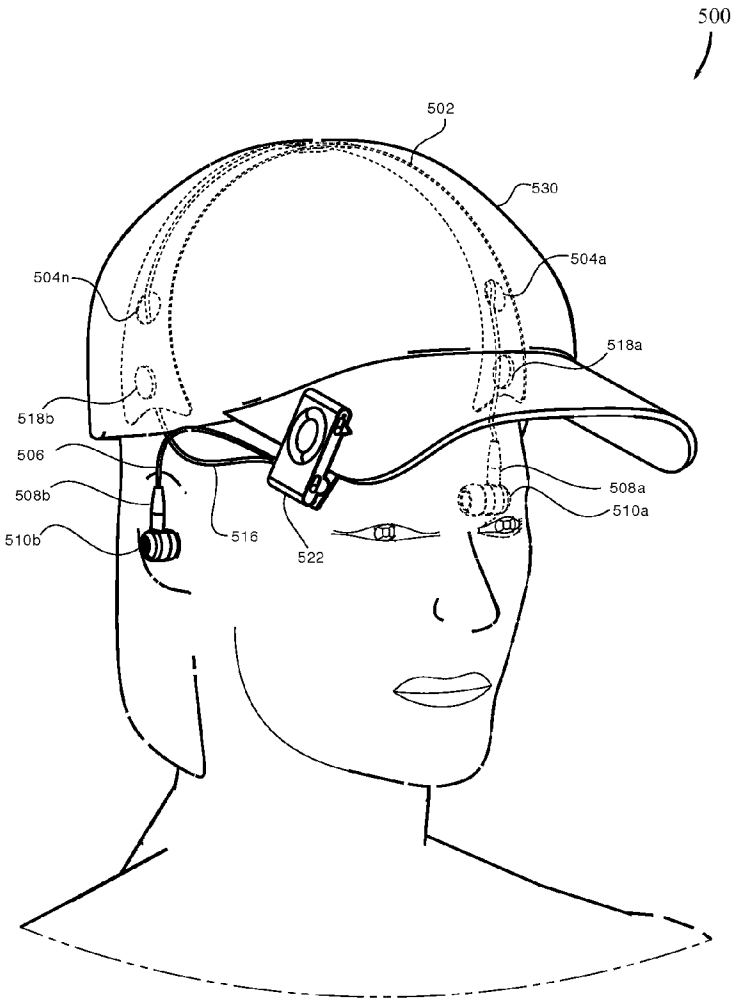
FIG. 5 is a diagram illustrating an exemplary listening device aid hidden within an article of clothing with earphone speakers installed in human ears in which aspects of the present invention may be realized.

FIG. 5 is a diagram illustrating an exemplary listening device aid 500 hidden within an article of clothing with earphone speakers installed in human ears in which aspects of the present invention may be realized. As illustrated, the flexible strap 502 is positioned, secured, and hidden within a baseball type hat 530. The first headphone cord 516 is routed through the openings 504 (504*a-n*) and is thereby secured to the flexible strap 502 while the listening device 500 is secured within the hat 530. Since the length of the first headphone cord 516 is greater than the length of the second headphone cord 506, the first headphone cord 516 is able to traverse and be routed along the flexible strap 502 to reach the ear farthest away from the second headphone cord that extends downward to a human ear. The first headphone cord 516 reaches the left side of a person's head so as to allow the first earphone body 510*a* to be inserted into the left ear. (It should be noted that the listening device aid 500 may be installed in a reverse direction where the first earphone body 510*a* is routed through the flexible strap 502 to reach a right ear rather than a left ear.

Also, the first earphone body 510*a* is connected to the first headphone cord 516 for converting the sound signals to audible sounds. The second earphone body 510*b* is connected to the second headphone cord 506 for converting the sound signals to audible sounds. The first earphone body 510*a* and the second earphone body 510*b* are shaped to be retained in one of a concha cavity of a human ear and the article of clothing. The first headphone cord 516 is coupled to the first earphone body 510*a* with an attachment point 508 such that the headphone body 510*a* is lower than the attachment point 510*a*. In other words, the attachment point 508 (e.g., an audio input device) is located above the first earphone body 510*a* and the second earphone body 510*b* because of the geometry of the human ear and allows the headphones to more easily remain in the ear since the first earphone body 510*a* and the second earphone body 510*b* are at the lowest point of the earphone device (FIG. 2 200). This can be seen in FIG. 5 as the first earphone body 510*a* and the second earphone body 510*b* are positioned in an active listening position with the first earphone body 510*a* and the second earphone body 510*b* installed in human ears. The attachment point 508, as seen in FIG. 5, is connected above the first earphone body 510*a* and the second earphone body 510*b* allowing the first earphone body 510*a* and the second earphone body 510*b* to be quickly and easily installed in the human ear. Gravity becomes irrelevant as the first earphone body 510*a* and the second earphone body 510*b* are secured by the listening device 500 positioned above the ears. In short, the first earphone body 510*a* and the second earphone body 510*b* extend downward away from the flexible strap towards the ground and into the ear. Moreover, the media device 522 (e.g., a mini MP3 player) is coupled to at least a portion of the first headphone cord 516 or the second headphone cord 506 for securing the earphone to an article of clothing, which further assists with safety and comfort for a user, particularly when the music listener needs to start, stop, pause, change volume, an/or change a track. FIG. 5 illustrates that a media device (e.g., a mini MP3 player) includes a clip for securing the media device 322 to an article of clothing (e.g., a helmet, hat, and/or visor, etc.) In FIG. 5, the clip of the media device 522 is connected to the front brim of the hat 530 to secure the media device 522. In this manner, the listening device 500 may be easily installed and placed within the hat 530 with the media device 522 easily being attached to the hat 530. Moreover, even with gloves on a person's hands, the media device 522 may easily be controlled and manipulated, which is difficult and dangerous when the media device 522 is placed within a jacket, coat, shirt, etc.

Figure 6:
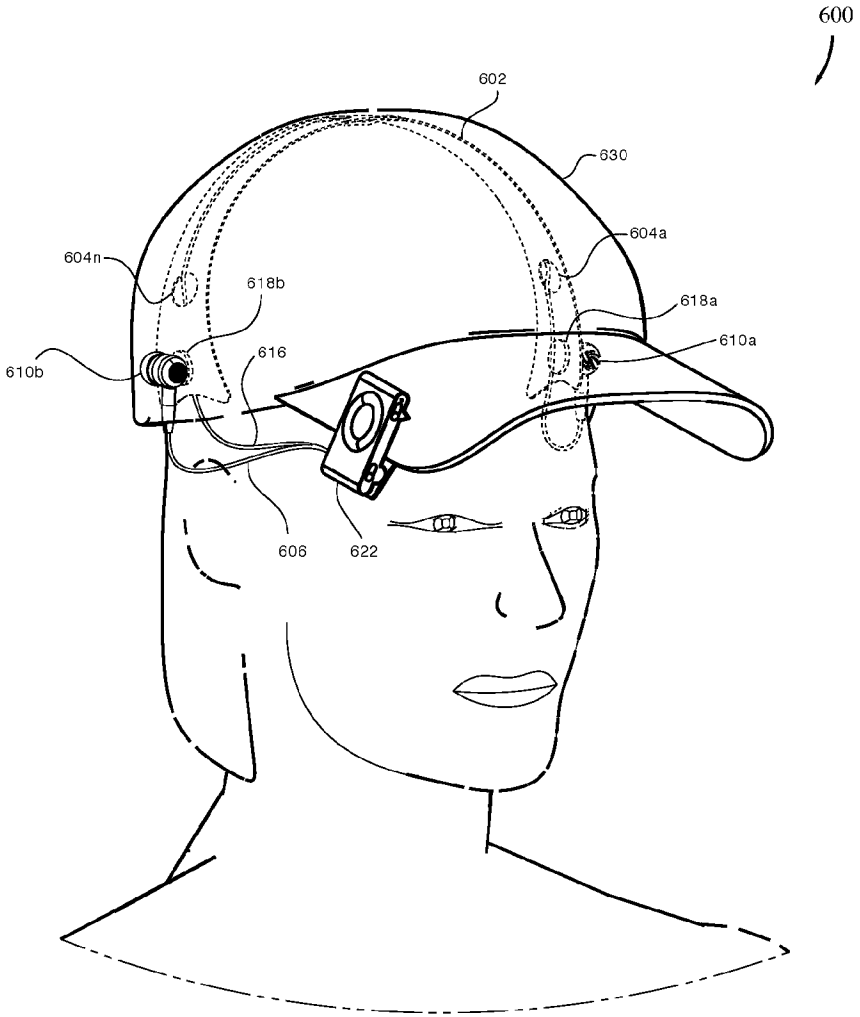
FIG. 6 is an additional diagram illustrating an exemplary listening device aid hidden within an article of clothing with earphone speakers attracted to a magnet of the listening device aid in which aspects of the present invention may be realized.

FIG. 6 is an additional diagram illustrating an exemplary listening device aid 600 hidden within an article of clothing with earphone speakers connected to a magnet of the listening device aid in which aspects of the present invention may be realized. As illustrated, the flexible strap 602 is positioned, secured, and hidden within a baseball type hat 630. The first headphone cord 616 is routed through the openings 604 (604*a-n*) and is thereby secured to the flexible strap 602 while the listening device 600 is secured within the hat 630. Since the length of the first headphone cord 616 is greater than the length of the second headphone cord 606, the first headphone cord 616 is able to traverse and be routed along the flexible strap 602. As illustrated, the first headphone cord 616 is connected to a media device 622 and is routed through the flexible strap via openings 604 to secure the first headphone cord 616 to the flexible strap 602. The first headphone cord 616 reaches the left side of a person's head so as to allow the first earphone body 610*a* to be inserted into the left ear or connected to a magnet contained within slots 618 (e.g., circular openings/groves and shown in FIG. 6 as 618*a* and 618*b*) for receiving the magnets. The magnets included in the slots 618 allow for the first earphone body 610*a* and the second earphone body 610*b* to be secured by the magnets to the flexible strap 602 when the first earphone body 610*a* and the second earphone body 610*b* are desired to be stored/secured when not in use in a person's ear. The magnets included in slots 618 may be a variety of shapes, sizes, and strengths according to the article of clothing to be used with the listening device 600. The magnets may be secured within the slots 618 by a variety of means including, but not limited to, gluing, pasting, sticking, pinning, and or retained by portions of the flexible strap 602 by creating molded seals to be flexed and adjustable for securing and retaining the magnets. As illustrated in FIG. 6, the first earphone body 610*a* (e.g., headphone speaker) is connected the slots 618 with the magnets and are secured to the flexible strap 602 by the magnets.

Moreover, a media device 622 (e.g., a mini MP3 player) is coupled to at least a portion of the first headphone cord 616 or the second headphone cord 606 for securing the earphone to an article of clothing, which further assists with safety and comfort for a user, particularly when the music listener needs to start, stop, pause, change volume, an/or change a track. FIG. 6 illustrates that a media device (e.g., a mini MP3 player) includes a clip for securing the media device 322 to an article of clothing (e.g., a helmet, hat, and/or visor, etc.) In FIG. 6, the clip of the media device 622 is connected to the front brim of the hat 630 to secure the media device 622. In this manner, the listening device 600 may be easily installed and placed within the hat 630 with the media device 622 easily being attached to the hat 630. Moreover, even with gloves on a person's hands, the media device 622 may easily be controlled and manipulated, which is difficult and dangerous when the media device 622 is placed within a jacket, coat, shirt, etc.

Figure 7:
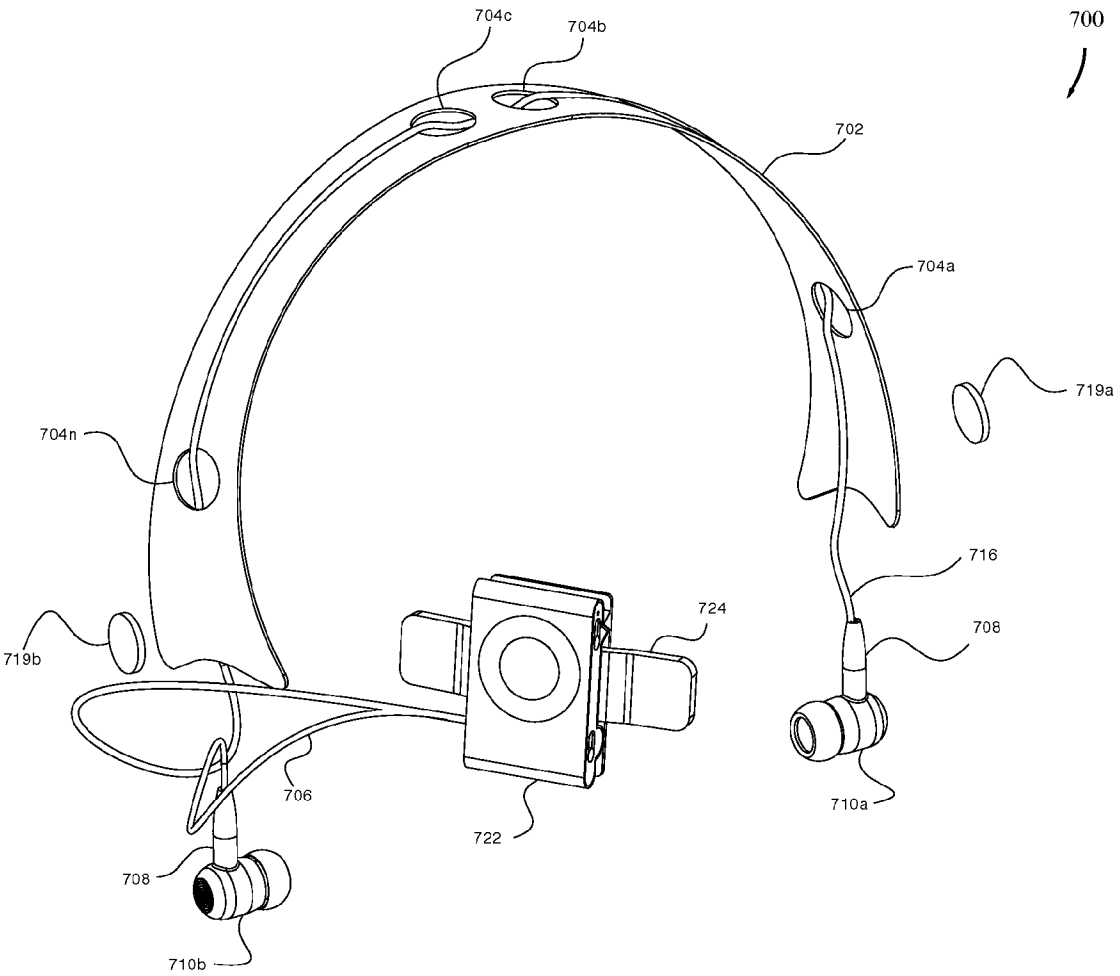
FIG. 7 is an additional diagram illustrating an exemplary listening device aid in which aspects of the present invention may be realized.

FIG. 7 is an additional diagram illustrating an exemplary listening device aid 700 in which aspects of the present invention may be realized. FIG. 7 illustrates the combination of FIG. 1, FIG. 2, and FIG. 3 as applied to the present invention. The listening device 700 includes all of the embodiments within FIG. 1, FIG. 2, and FIG. 3. The flexible strap 702 may be of a variety of lengths, shapes and sizes based on the various articles of clothing that would be worn on the head requires. The flexible strap 702 also contains a number of openings 704 (e.g., holes and labeled in FIG. 7 as 704*a-n*) for allowing an earphone/headphone cord to be routed through the flexible strap 702. The openings 704 may be of a variety of diameters and sizes based on the size and width of the flexible strap 702 and may be positioned in a variety of locations along the flexible strap 702. The earphone device (as illustrated in FIG. 2 200) illustrates the first headphone cord 716, having a first length that is connected to the earphone plug 720. A second headphone cord 706, having a second length, is also connected to the earphone plug 720. The first headphone cord 716 is routed through the flexible strap 702. As illustrated in FIG. 7, the first headphone cord 716 is routed through the openings 704 (704*a-n*) and is thereby secured to the flexible strap 702. Since the length of the first headphone cord 716 is greater than the length of the second headphone cord 706, the first headphone cord 716 is able to traverse and be routed along the flexible strap 702. Also, the first earphone body 710*a* is connected to the first headphone cord 716 for converting the sound signals to audible sounds. The second earphone body 710*b* is connected to the second headphone cord 706 for converting the sound signals to audible sounds. The first earphone body 710*a* and the second earphone body 710*b* are shaped to be retained in one of a concha cavity of a human ear and the article of clothing. The first headphone cord 716 is coupled to the first earphone body 710*a* with an attachment point 708 such that the headphone body 710*a* is lower than the attachment point 710*a*. In other words, the attachment point 708 (e.g., an audio input device) is located above the first earphone body 710*a* and the second earphone body 710*b* because of the geometry of the human ear and allows the headphones to more easily remain in the ear since the first earphone body 710*a* and the second earphone body 710*b* are at the lowest point of the earphone device (FIG. 2 200). An attachment mechanism 722 (e.g., a media device) or a strap for securing the attachment mechanism is coupled to at least a portion of the first headphone cord 716 or the second headphone cord 706 for securing the earphone to an article of clothing. FIG. 7 illustrates that a media device 722 (e.g., a mini MP3 player) having an additional flexible strap device 724 (e.g., a helmet bonding strap) included with the media device 722 for securing the media device 722 to an article of clothing (e.g., a helmet, hat, and/or visor, etc.) Similar to the flexible strap described in FIG. 1, the additional flexible device 724 may be designed, developed, and comprised of the same material as the flexible strap 702 (see also FIG. 1 102) except the additional flexible strap 724 may be configured in a variety of ways and manners different than the flexible strap 702 depending on the type of media device 722 the additional flexible strap would be required to secure. In one embodiment, FIG. 7 illustrates a configuration for an open face helmet. Self-adhesive magnets 719 (illustrated in FIG. 7 as 719*a* and 719*b*) attach to the outside of a helmet/hat (not shown). The flexible strap 702 is fastened/secured (e.g., glued or taped) externally and/or internally to the helmet. The media device 722 clips/fastens onto the bonding strap (e.g., the additional flexible strap) 724 and is used to fasten, clip, and/or secure the media device 722 to the helmet, hat, and/or even the flexible strap 702.

Figure 8:
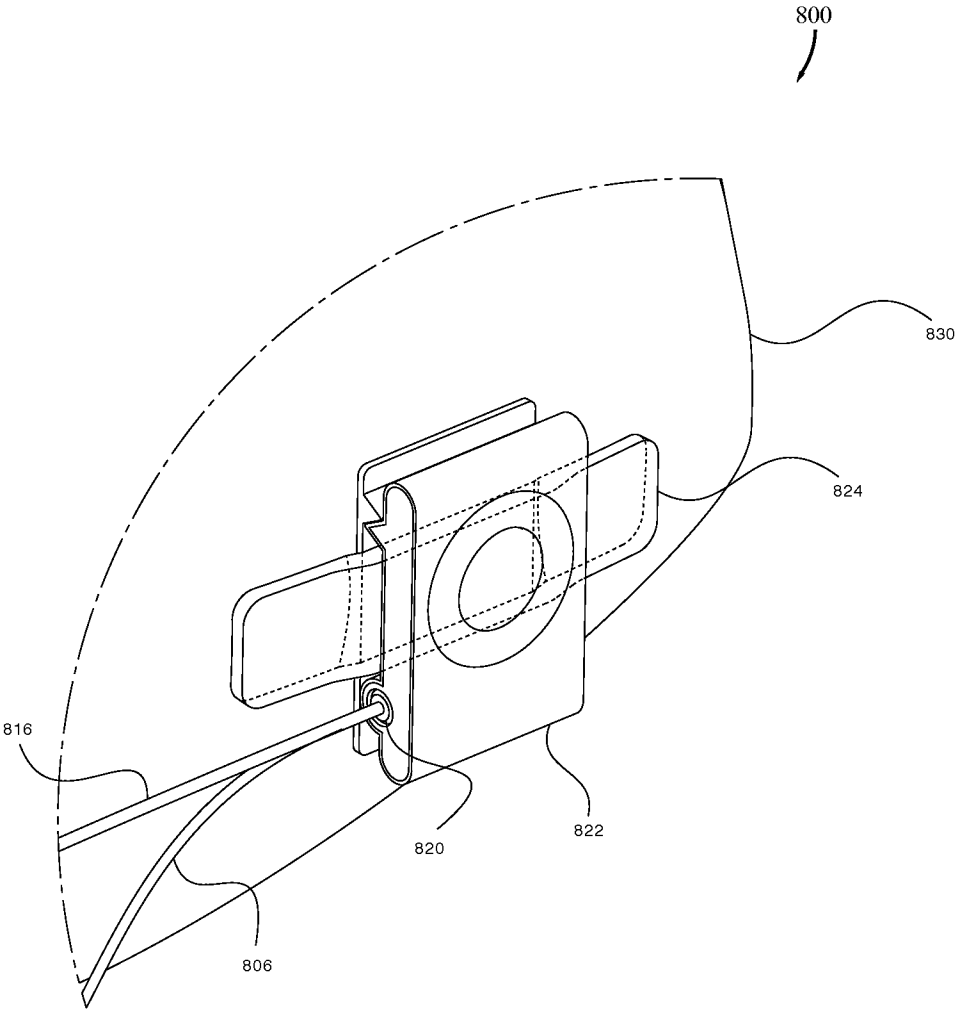
FIG. 8 is a diagram illustrating an exemplary strap securing a media device to an article of clothing in which aspects of the present invention may be realized.

FIG. 8 is a diagram illustrating an exemplary strap 800 securing a media device to an article of clothing in which aspects of the present invention may be realized. FIG. 8 illustrates that a media device 822 (e.g., a mini MP3 player) with an additional flexible strap device 824 included with the media device 822 for securing the media device 822 to an article of clothing (e.g., a helmet, hat, and/or visor, etc.) 830. Similar to the flexible strap 102 mentioned in FIG. 1, the additional flexible device 824 may be designed, developed, and comprised of the same material as the flexible strap 802 (see also FIG. 1 102) except the additional flexible strap 824 may be configured in a variety of ways and manners that are perhaps different than the flexible strap (FIG. 1 102) depending on the type of media device 822 the additional flexible strap 824 would be required to secure. Also, similar to the flexible strap 102 mentioned in FIG. 1, the additional flexible device 824 may have a variety of adhesive type material applied to any portion thereof for securing the media device 822 to the article of clothing for the head. The adhesive material may include, but not limited to, tape, glue, buttons, clips, suction cups, Velcro®, a heat seal, reactive/non-reactive and/or natural synthetic type adhesives, and/or any type of substance known in the art that unites, bonds, secures, fastens, and/or sticks to the article of clothing or protective device for the head. Also, the first headphone cord 816 and the second headphone cord 806 is shown being connected to the media device 822 while the media device 822 is being secured to the hat/helmet 830 via the additional flexible strap 824.

Figure 9:
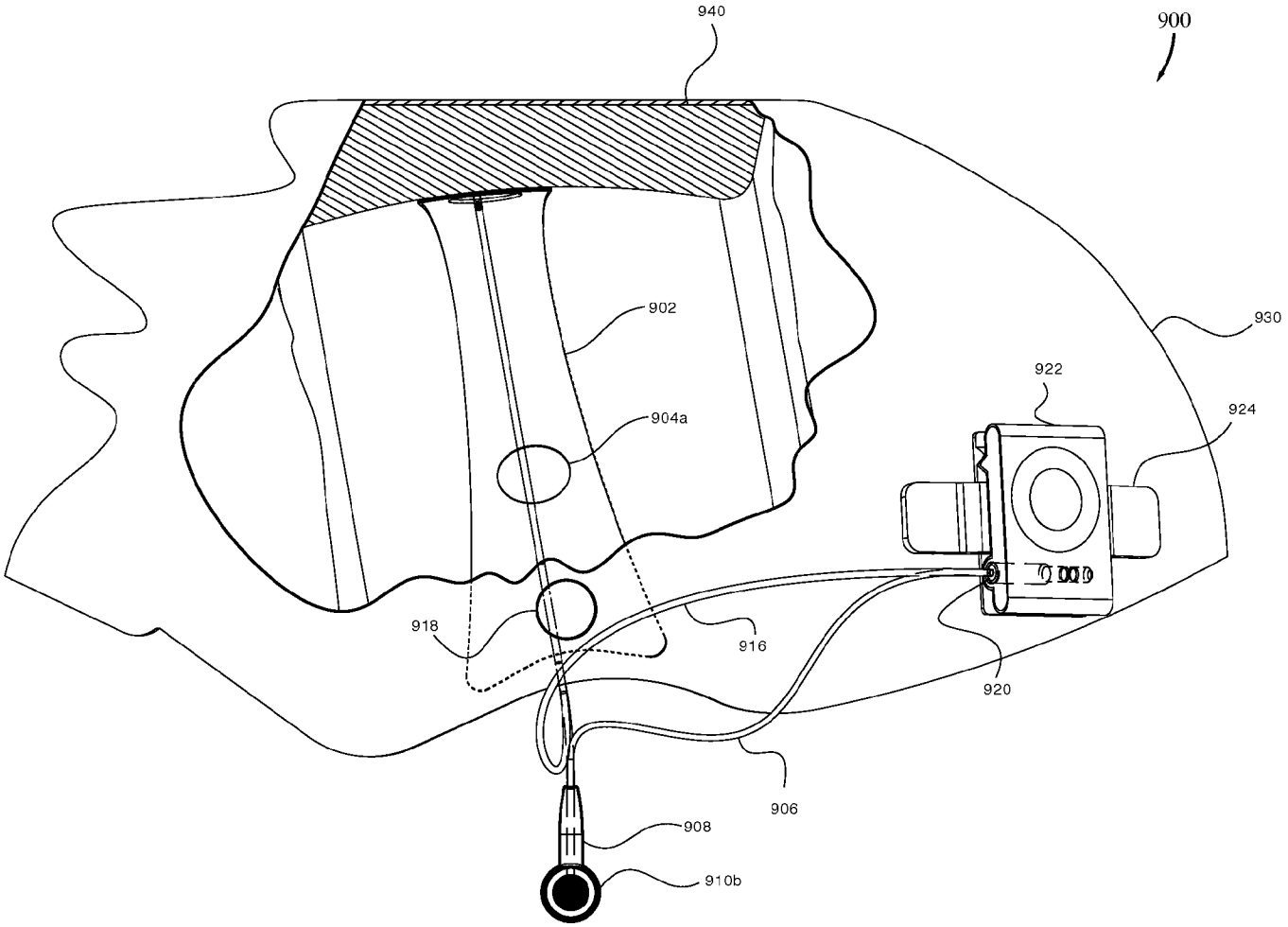
FIG. 9 is a diagram illustrating an exemplary flexible strap secured to an article of clothing in which aspects of the present invention may be realized.

FIG. 9 is a diagram illustrating an exemplary flexible strap 900 secured to an article of clothing in which aspects of the present invention may be realized. FIG. 9 illustrates the combination of FIG. 1, FIG. 2, and FIG. 3 as applied to the present invention. The listening device 900 includes all of the embodiments within FIG. 1, FIG. 2, and FIG. 3. The flexible strap 902 is bonded/secured inside of the article of clothing (e.g., an open face helmet) to a foam padding 940 within the helmet 930. This may be a permanent connection/bond and or a temporary bonding (e.g., by use of Velcro®). The flexible strap 902 also contains a number of openings 904*a* for allowing an earphone/headphone cord to be routed through the flexible strap 902. The openings 904 may be of a variety of diameters and sizes based on the size and width of the flexible strap 902 and may be positioned in a variety of locations along the flexible strap 902. The earphone device (as shown in FIG. 2 200) illustrates the first headphone cord 916, having a first length that is connected to the earphone plug 920. A second headphone cord 906, having a second length, is also connected to the earphone plug 920. The first headphone cord 916 is routed through the flexible strap 902. As illustrated in FIG. 9, the first headphone cord 916 is routed through the openings 904 (904*a-n*) and is thereby secured to the flexible strap 902. Since the length of the first headphone cord 916 is greater than the length of the second headphone cord 906, the first headphone cord 916 is able to traverse and be routed along the flexible strap 902. Also, the first earphone body 910*a* is connected to the first headphone cord 916 for converting the sound signals to audible sounds. The second earphone body 910*b* is connected to the second headphone cord 906 for converting the sound signals to audible sounds. The first earphone body (not shown) and the second earphone body 910*b* are shaped to be retained in one of a concha cavity of a human ear and the article of clothing. The first headphone cord 916 is coupled to the second earphone body 910*b* with an attachment point 908 such that the second earphone body 910*b* is lower than the attachment point 908. In other words, the attachment point 908 (e.g., an audio input device) is located above the first earphone body and the second earphone body 910*b* because of the geometry of the human ear and allows the headphones to more easily remain in the ear since the first earphone body and the second earphone body 910*b* are at the lowest point of the earphone device (FIG. 2 200). An attachment mechanism 922 (e.g., a media device) with an additional flexible strap device 924 is illustrated securing the attachment mechanism 922 to at least a portion of the first headphone cord 916 or the second headphone cord 906 for securing the earphone to an article of clothing 930. FIG. 9 illustrates that a media device 922 (e.g., a mini MP3 player) is coupled to an additional flexible strap device 924 for securing the media device 922 to an article of clothing (e.g., a helmet, hat, and/or visor, etc.) Similar to the flexible strap 102 mention in FIG. 1, the additional flexible device 924 may be designed, developed, and comprised of the same material as the flexible strap 902 (see also FIG. 1 102). In one embodiment, FIG. 9 illustrates a configuration for an open face helmet. Self adhesive magnets 918 attach to the outside of a helmet/hat 930 or may be included flexible strap 902 so as to allow the first earphone body and the second earphone body 910*b* to be secured to the flexible strap 902 by the magnets housed within the slots 918 of the flexible strap 902. The media device 922 clips/fastens onto the bonding strap 924 (e.g., the additional flexible strap) 924 and is used to fasten, clip, and/or secure the media device 922 to the helmet 930 and/or even the flexible strap 902.

Figure 10:
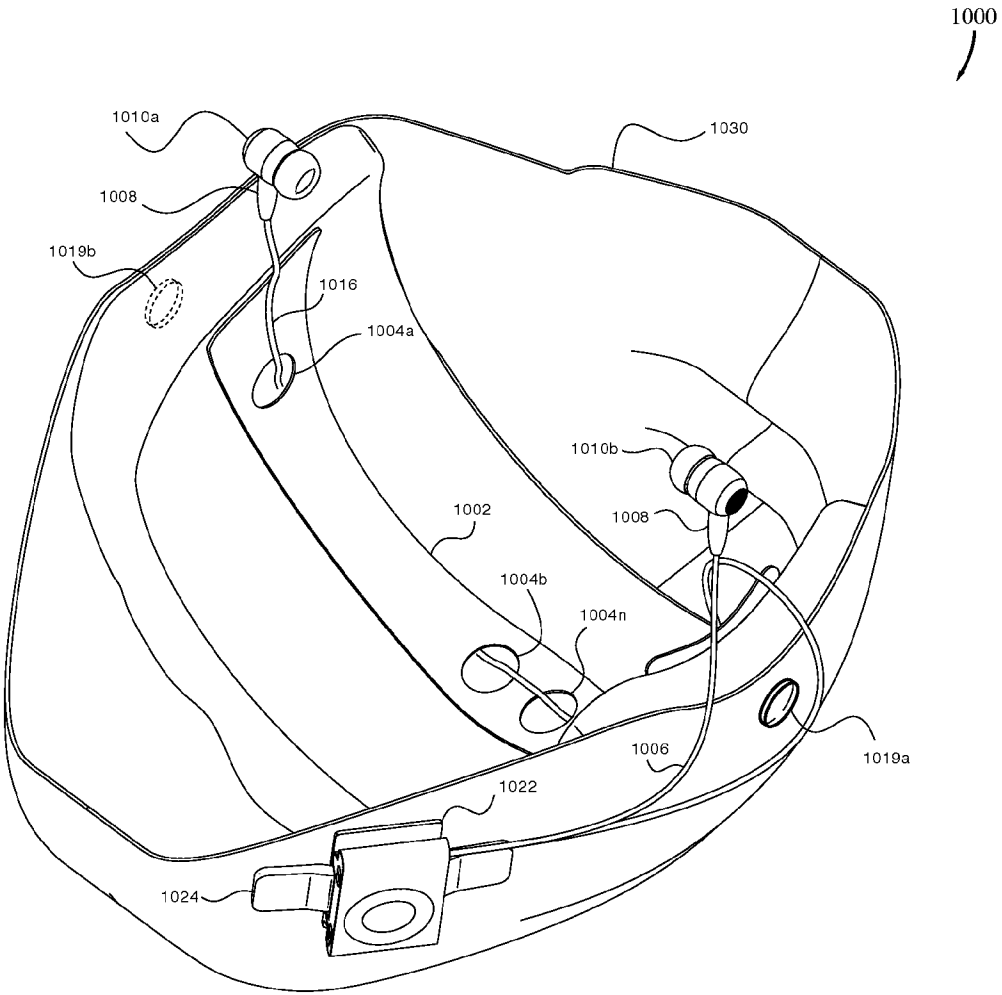
FIG. 10 is a diagram illustrating an exemplary listening device aid secured within an article of clothing in which aspects of the present invention may be realized.

FIG. 10 is a diagram illustrating an exemplary listening device aid 1000 secured within an article of clothing in which aspects of the present invention may be realized. In one embodiment, the listening device aid 1000 is illustrated from a view looking inside of a helmet device 1030. FIG. 10 illustrates the combination of FIGS. 1-3 as applied to the present invention. The listening device 1000 includes all of the embodiments within FIGS. 1-3. The flexible strap 1002 is bonded/secured internally to the article of clothing (e.g., an open face helmet) by connecting the flexible strap 1002 to a foam padding 1040 within the helmet 1030. This may be a permanent connection/bond and or a temporary bonding (e.g., by use of Velcro®). The flexible strap 1002 also contains a number of openings 1004 (e.g., holes and labeled, in FIG. 10 as 1004*a-n*) for allowing an earphone/headphone cord to be routed through the flexible strap 1002. The openings 1004 may be of a variety of diameters and sizes based on the size and width of the flexible strap 1002 and may be positioned in a variety of locations along the flexible strap 1002, The earphone device (as shown in FIG. 2 200) illustrates the first headphone cord 1016, having a first length that is connected to the earphone plug (not shown). A second headphone cord 1006, having a second length, is also connected to the earphone plug. The first headphone cord 1016 is routed through the flexible strap 1002. As illustrated in FIG. 10, the first headphone cord 1016 is routed through the openings 1004 (1004*a-n*) and is thereby secured to the flexible strap 1002. Since the length of the first headphone cord 1016 is greater than the length of the second headphone cord 1006, the first headphone cord 1016 is able to traverse and be routed along the flexible strap 1002. Also, the first earphone body 1010*a* is connected to the first headphone cord 1016 for converting the sound signals to audible sounds. The second earphone body 1010*b* is connected to the second headphone cord 1006 for converting the sound signals to audible sounds. The first earphone body 1010*a* and the second earphone body 1010*b* are shaped to be retained in one of a concha cavity of a human car and the article of clothing. The first headphone cord 1016 is coupled to the second earphone body 1010*b* with an attachment point 1008 such that the second earphone body 1010*b* is lower than the attachment point 1008. In other words, the attachment point 1008 (e.g., an audio input device) is located above the first earphone body 1010*a* and the second earphone body 1010*b* because of the geometry of the human ear and allows the headphones to more easily remain in the ear since the first earphone body 1010*a* and the second earphone body 1010*b* are at the lowest point of the earphone device (FIG. 2 200). An attachment mechanism 1022 (e.g., a media device) with an additional flexible strap device 1024 is illustrated securing the attachment mechanism 1022 to at least a portion of the first headphone cord 1016 or the second headphone cord 1006 for securing the earphone to an article of clothing 1030. FIG. 10 illustrates that a media device 1022 (e.g., a mini MP3 player) with an additional flexible strap device 1024 included with the media device for securing the media device 1022 to an article of clothing (e.g., a helmet, hat, and/or visor, etc.) Similar to the flexible strap 102 mention in FIG. 1, the additional flexible device 1024 may be designed, developed, and comprised of the same material as the flexible strap 1002 (see also FIG. 1 102) except the additional flexible strap 1024 may be configured in a variety of different ways and manners than the flexible strap 1002 depending on the type of media device 1022 the additional flexible strap 1024 would be required to secure. In one embodiment, FIG. 10 illustrates a configuration for an open face helmet. Self adhesive magnets 1019*a* and 1019*b* attach to the outside of a helmet/hat 1030 to allow the first earphone body 1010*a* and the second earphone body 1010*b* to be secured to the helmet 1030. The media device 1022 clips/fastens onto the bonding strap (e.g., the additional flexible strap) 1024 and is used to fasten, clip, and/or secure the media device 1022 to the helmet, hat, and/or even the flexible strap 1002.

Moreover, FIG. 10 illustrates a configuration for an open face helmet with self adhesive magnets 1019 attach to the outside of a helmet/hat 1030. The magnets 1019 allow the first earphone body 1010*a* and the second earphone body 1010*b* to be secured to the helmet 1030 when the first earphone body 1010*a* and the second earphone body 1010*b* are not in a user's ears. The media device 1022 clips/fastens onto the bonding strap (e.g., the additional flexible strap) 1024 and is used to fasten, clip, bond, and/or secure the media device 1022 to the helmet, hat, and/or even the flexible strap 1002, if necessary.

Figure 11:
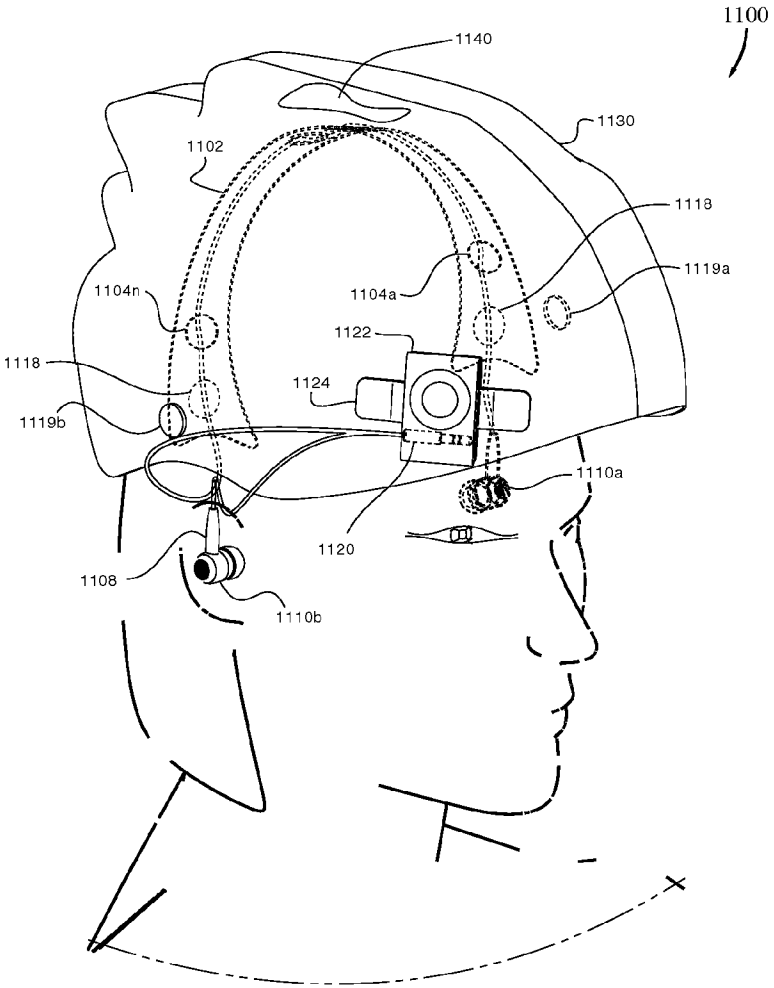
FIG. 11 is a diagram illustrating an exemplary isometric side view of a listening device aid secured within an article of clothing with magnets attached to the outside of the article of clothing in which aspects of the present invention may be realized.

FIG. 11 is a diagram illustrating an exemplary isometric side view of a listening device aid 1100 secured within an article of clothing with magnets attached to the outside of the article of clothing in which aspects of the present invention may be realized. In one embodiment, the listening device aid 1100 is illustrated from an isometric view showing magnets 1119 (119*a-b*) being attached to the outside of a helmet shell 1130 with the flexible strap 1102 being secured within the helmet device 1130. FIG. 11 illustrates the combination of FIGS. 1-3, and 10 as applied to the present invention. The listening device 1100 includes all of the embodiments within FIGS. 1-3, and 10. The flexible strap 1102 may be of a variety of lengths, shapes and sizes based on the various articles of clothing that would be worn on the head requires. The flexible strap 1102 is bonded/secured internally to the article of clothing (e.g., an open face helmet) by connecting the flexible strap 1102 to a foam padding 1140 within the helmet 1130. This may be a permanent connection/bond and or a temporary bonding (e.g., by use of Velcro®). The flexible strap 1102 also contains a number of openings 1104 (e.g., holes and labeled in FIG. 11 as 1104*a-n*) for allowing au earphone/headphone cord to be routed through the flexible strap 1102. The openings 1104 may be of a variety of diameters and sizes based on the size and width of the flexible strap 1102 and may be positioned in a variety of locations along the flexible strap 1102. The earphone device (as shown in FIG. 2 200) illustrates the first headphone cord 1116, having a first length that is connected to the earphone plug 1120. A second headphone cord 1106, having a second length, is also connected to the earphone plug 1120. The first headphone cord 1116 is routed through the flexible strap 1102. As illustrated in FIG. 11, the first headphone cord 1116 is routed through the openings 1104 (1104*a-n*) and is thereby secured to the flexible strap 1102. Since the length of the first headphone cord 1116 is greater than the length of the second headphone cord 1106, the first headphone cord 1116 is able to traverse and be routed along the flexible strap 1102. Also, the first earphone body 1110*a* is connected to the first headphone cord 1116 for converting the sound signals to audible sounds. The second earphone body 1110*b* is connected to the second headphone cord 1106 for converting the sound signals to audible sounds. The first earphone body 1110*a* and the second earphone body 1110*b* are shaped to be retained in our of a concha cavity of a human ear and the article of clothing. The first headphone cord 1116 is coupled to the second earphone body 1110*b* with an attachment point 1108 such that the second earphone body 1110*b* is lower than the attachment point 1108. In other words, the attachment point 1108 (e.g., an audio input device) is located above the first earphone body 1110*a* and the second earphone body 1110*b* because of the geometry of the human ear and allows the headphones to more easily remain in the ear since the first earphone body 1110*a* and the second earphone body 1110*b* are at the lowest point of the earphone device (FIG. 2 200). As illustrated in FIG. 11, the first and second earphone body's 1110*a* and 1110*b* are inserted into the ear and the attachment point 1108 is above both earphone body 1110 (e.g., earphone body 1110*a* and 1110*b*).

An attachment mechanism 1122 (e.g., a media device) with an additional flexible strap device 1124 is illustrated securing the attachment mechanism 1122 to at least a portion of the first headphone cord 1116 or the second headphone cord 1106 for securing the earphone to an article of clothing 1130. FIG. 11 illustrates that a media device 1122 (e.g., a mini MP3 player) having an additional flexible strap device 1124 included with the media device for securing the media device 1122 to an article of clothing (e.g., a helmet, hat, and/or visor, etc.) Similar to the flexible strap 102 mentioned in FIG. 1, the additional flexible device 1124 may be designed, developed, and comprised of the same material as the flexible strap 1102 (see also FIG. 1 102) except the additional flexible strap 1124 may be configured in a variety of different ways and manners than the flexible strap 1124 depending on the type of media device 1122 the additional flexible strap 1124 would be required to secure. In one embodiment, FIG. 11 illustrates a configuration for an open face helmet. Self adhesive magnets attach to the outside of a helmet/hat (not shown) or may be included with the flexible strap 1102 so as to allow the first earphone body 1110*a* and the second earphone body 1110*b* to be secured to the flexible strap 1102 by the magnets housed within the slots 1118 of the flexible strap 1102. The media device 1122 clips/fastens onto the bonding strap (e.g., the additional flexible strap) 1124 and is used to fasten, clip, and/or secure the media device 1122 to the helmet, hat, and/or even the flexible strap 1102.

Moreover, FIG. 11 illustrates a configuration for an open face helmet with self adhesive magnets 1119 attach to the outside of a helmet/hat 1130. The magnets 1119 allow the first earphone body 1110*a* and the second earphone body 1110*b* to be secured to the helmet 1130 when the first earphone body 1110*a* and the second earphone body 1110*b* are not in a user's ears. However, as illustrated in FIG. 11, the first earphone body 1110*a* and the second earphone body 1110*b* are placed and inserted into a music listeners ears while the listening device aid 1100 is secured within a helmet shell 1130 placed on the person's head. Also, the media device 1122 clips/fastens onto the bonding strap (e.g., the additional flexible strap) 1124 and is used to fasten, clip, bond, and/or secure the media device 1122 to the helmet, hat, and/or even the flexible strap 1102.

Figure 12:
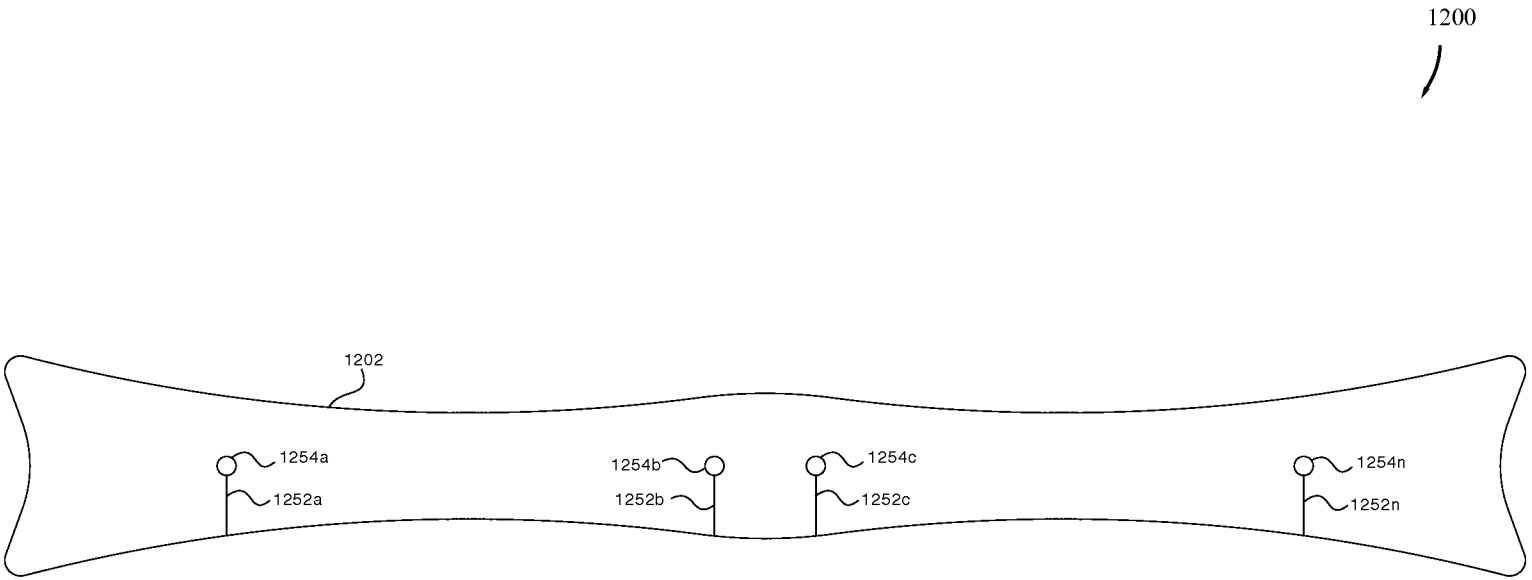
FIG. 12 is a diagram illustrating an exemplary flexible strap device having holes with slits for holding and routing earphone cords in which aspects of the present invention may be realized.

FIG. 12 is a diagram illustrating an exemplary flexible strap device having holes with slits for holding and routing earphone cords in which aspects of the present invention may be realized. FIG. 12 illustrated the flexible strap 1202 (also illustrated and described in FIG. 1 102) having small holes 1254 (illustrated in FIG. 12 as 1254*a-n*) spaced along portions of the flexible strap 1202. The holes 1254 are connected to slits 1252 (illustrated in FIG. 12 as 1252*a-n*) for allowing earphone/headphone cords (not shown) to be routed along and through the flexible strap 1202 and secured and held in place in the holes 1254. The flexible strap 1202 may be bent and manipulated for allowing the earphone cords to be slid into the slits 1252 and secured within the holes 1254. Upon the flexible strap 1202 returning to the un-manipulated state, the slits 1252 close together forming a barrier thereby preventing the earphone cords from sliding out of the holes in the flexible strap 1202.

Figure 13:
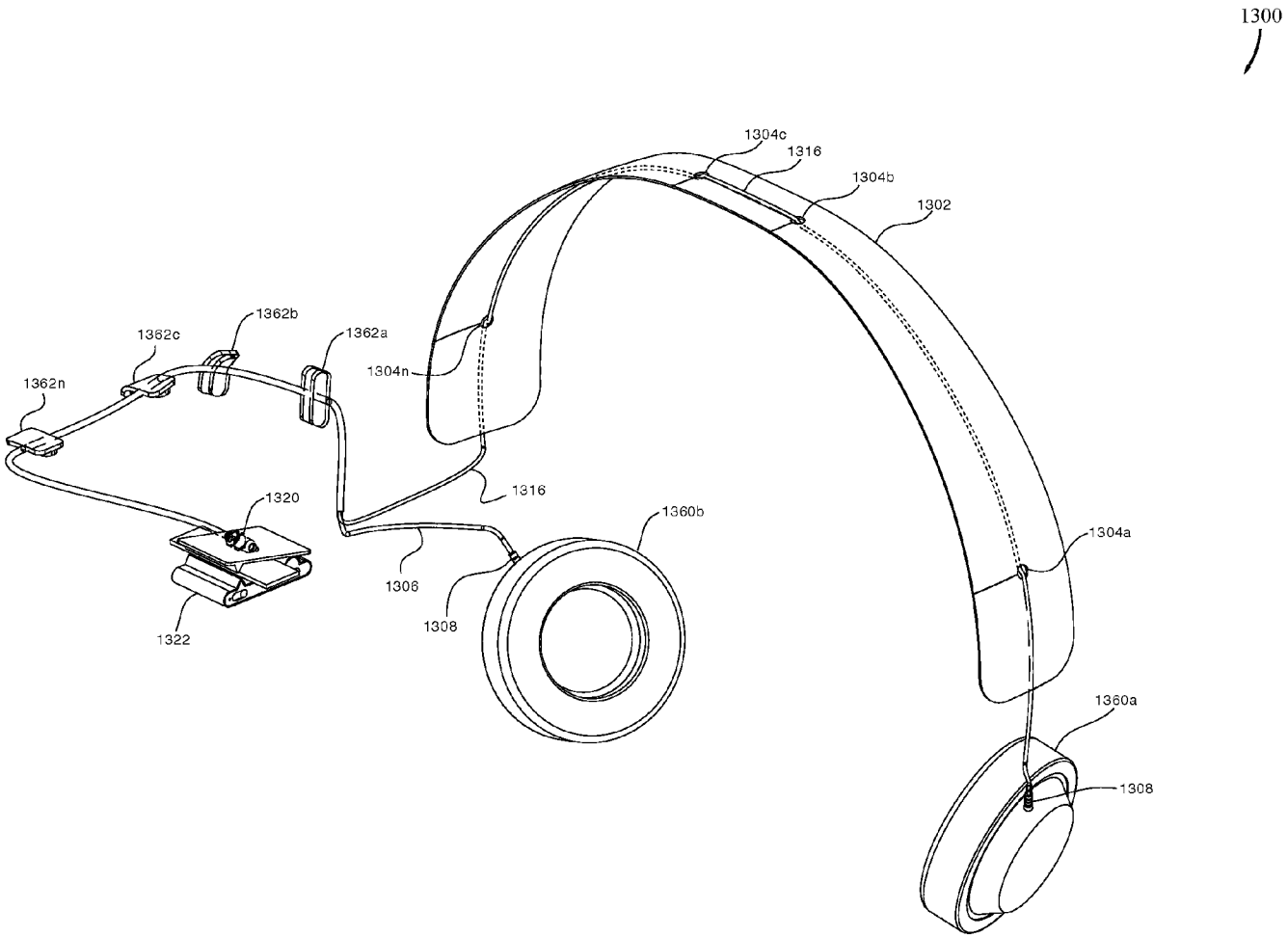
FIG. 13 is a diagram illustrating an exemplary listening device aid having earphones which cover a human ear in which aspects of the present invention may be realized.

FIG. 13 is a diagram illustrating an exemplary listening device aid having earphones that cover a human ear in which aspects of the present invention may be realized. The flexible strap 1302 may be of a variety of lengths, shapes and sizes based on the various articles of clothing that would be worn on the head requires. The flexible strap 1302 may be straight, curved, angled, and/or formed to a variety of geometric shapes or positions for being secured and/or hidden within the various articles of clothing that would be worn on the head (e.g. a baseball hat, helmet, wig, and/or visor). Moreover, the flexible strap 1302 also contains a number of openings 1304 (e.g., holes and labeled in FIG. 13 as 1304*a-n*) for allowing an earphone/headphone cord to be routed through the flexible strap 1302. The openings 1304 may be of a variety of diameters and sizes based on the size and width of the flexible strap 102 and may be positioned in a variety of locations along the flexible strap 102. As illustrated in FIG. 13, the openings 1304*a* and 1304*n* are placed on the ends of the flexible strap 1302 and the openings 1304*b* and 1304*c* are placed on in the center of the middle/top portion of the flexible strap 1302.

The earphone device (as shown in FIG. 2 200) illustrates the first headphone cord 1316, having a first length that is connected to the earphone plug 1320. A second headphone cord 1306, having a second length, is also connected to the earphone plug 1320. The first headphone cord 1316 is routed through the flexible strap 1302, as illustrated with the solid and dotted line along the center of the flexible strap 1302. As illustrated in FIG. 13, the first headphone cord 1316 is routed through the openings 1304 (1304*a-n*) and is thereby secured to the flexible strap 1302. Since the length of the first headphone cord 1316 is greater than the length of the second headphone cord 1306, the first headphone cord 1316 is able to traverse and be routed along the flexible strap 1302. Also, a first earphone body 1360*a*, which is large enough for surrounding and covering a human ear, is connected to the first headphone cord 1316 for converting the sound signals to audible sounds. The second earphone body 1360*b*, which is large enough for surrounding and covering a human ear, is connected to the second headphone cord 1306 for converting the sound signals to audible sounds. The larger earphone body 1360 may be have a hard, rigid, and/or semi-rigid outer portion with an soft, cushion like material on the inner portion that covers the ears for ease and comfort while surrounding the ear. Since many helmets have large spaces for the human ear, this space may be used to place the first and second earphone body 1360*a-b* into these holes/openings within the helmet. The earphone bodies 1360 may be large headphone speakers and be bonded/secured to the inside of the helmet. The first headphone cord 1316 is coupled to the first earphone body 1310*a* with an attachment point 1308 such that the headphone body 1310 is lower than the attachment point 1308. This allows less material to be used in the manufacturing process because of the close proximity between the audio input device 1322 and the earphone bodies 1360*a* and 1360*b*. An attachment mechanism 1322 (e.g., a media device) or a strap for securing the attachment mechanism is coupled to at least a portion of the first headphone cord 1316 or the second headphone cord 1306 for securing the earphone to an article of clothing. FIG. 13 illustrates that a media device 1322 (e.g., a mini MP3 player) includes a clip for securing the media device 1322 to an article of clothing (e.g., a helmet, hat, and/or visor, etc.) In addition, several hook and lock devices 1362 (illustrated in FIG. 13 as 1362*a-n*) are placed along the first headphone cord 1316 for hooking and locking the first headphone cord 1316 and then securing the first headphone cord 1316 to a helmet, helmet visor, or hat via the hook and lock devices 1362. These hook and look devices 1362 clamp and pin down the first headphone cord 1316 and tightly secure the first headphone cord 1316 by a variety of locking/clamping mechanisms commonly known in the art. The hook and lock devices 1362 may also be bonded/secured to the helmet by the various methods, as described above, similar to the flexible strap (FIG. 1 102).

Figure 14:
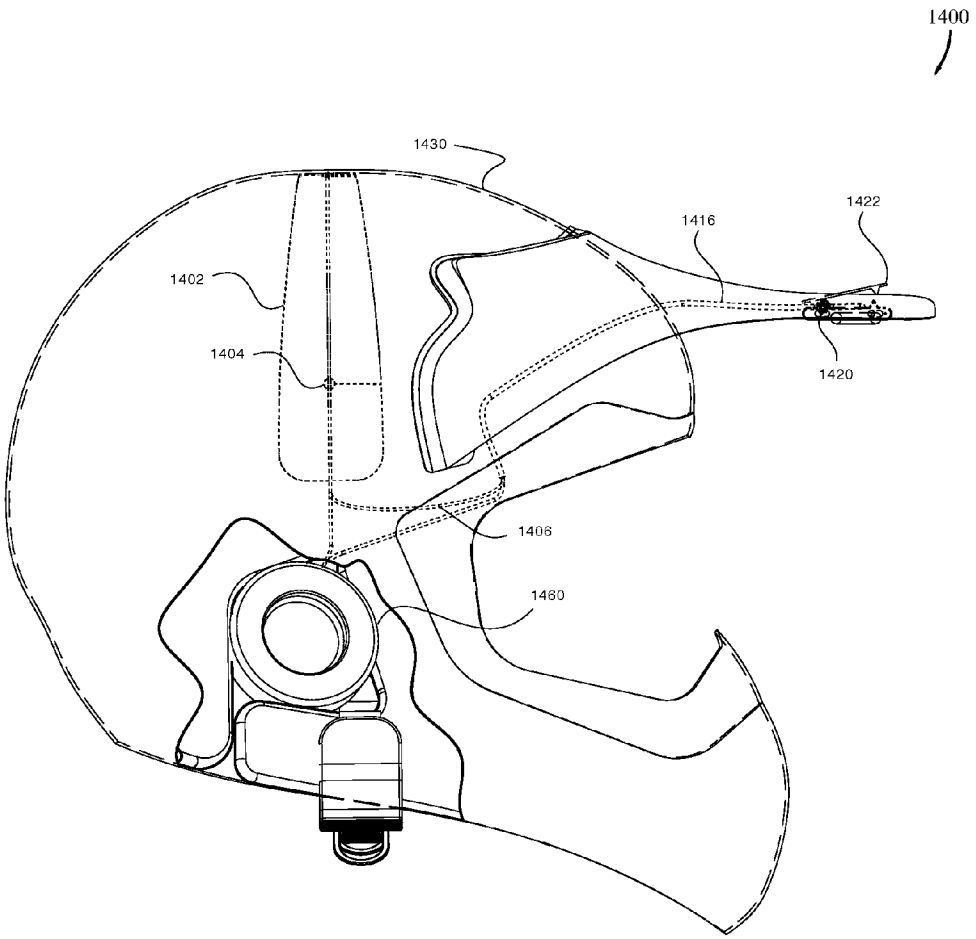
FIG. 14 is an diagram illustrating an exemplary listening device aid hidden within an article of clothing with earphones that cover a human ear attached to the article of clothing in which aspects of the present invention may be realized.

FIG. 14 is a diagram illustrating an exemplary listening device aid 1400 hidden within an article of clothing with earphones that cover a human ear attached to the article of clothing in which aspects of the present invention may be realized. FIG. 14 illustrates the combination of FIG. 1, FIG. 2, and FIG. 13 and includes all of the embodiments described therein. FIG. 14 illustrates in a side view, with a partial cut illustrating an earphone speaker attached to the helmet. The flexible strap 1402 is secured within a helmet 1430 and is mounted therein to the inside of the helmet shell, the inner foam (not shown), or a protective cushion placed internally within the helmet. The openings 1404 are positioned in a variety of locations along the flexible strap 1402 and illustrate the first headphone cord 1416 routed through the flexible straps 1402 via the opening holes/slits 1404. A second headphone cord 1406, having a second length, is also connected to the earphone plug 1420.

A first earphone body 1460, which is large enough for surrounding and covering a human ear, is connected to the first headphone cord 1416 for converting the sound signals to audible sounds. The second earphone body (not shown), which is large enough for surrounding and covering a human ear, is connected to the second headphone cord 1406 for converting the sound signals to audible sounds. Since many helmets 1430 have large spaces for the human ear, this space may be used to place the first and second earphone body 1460 into these holes/openings within the helmet. The size of the earphone body 1460 may vary and be larger or smaller depending upon the type of helmet/headgear. For example, the earphone body 1460 may be large headphone speakers and be bonded/secured to the inside of the helmet. As illustrated in FIG. 14, the earphone speaker 1460 is attached inside of the helmet and secured therein and remains in the fixed portion. Thus, the music listener may easily remove and put on the helmet 1430 while the flexible strap 1402 and the earphone speakers 1460 remain in a bonded/secured position.

Figure 15:
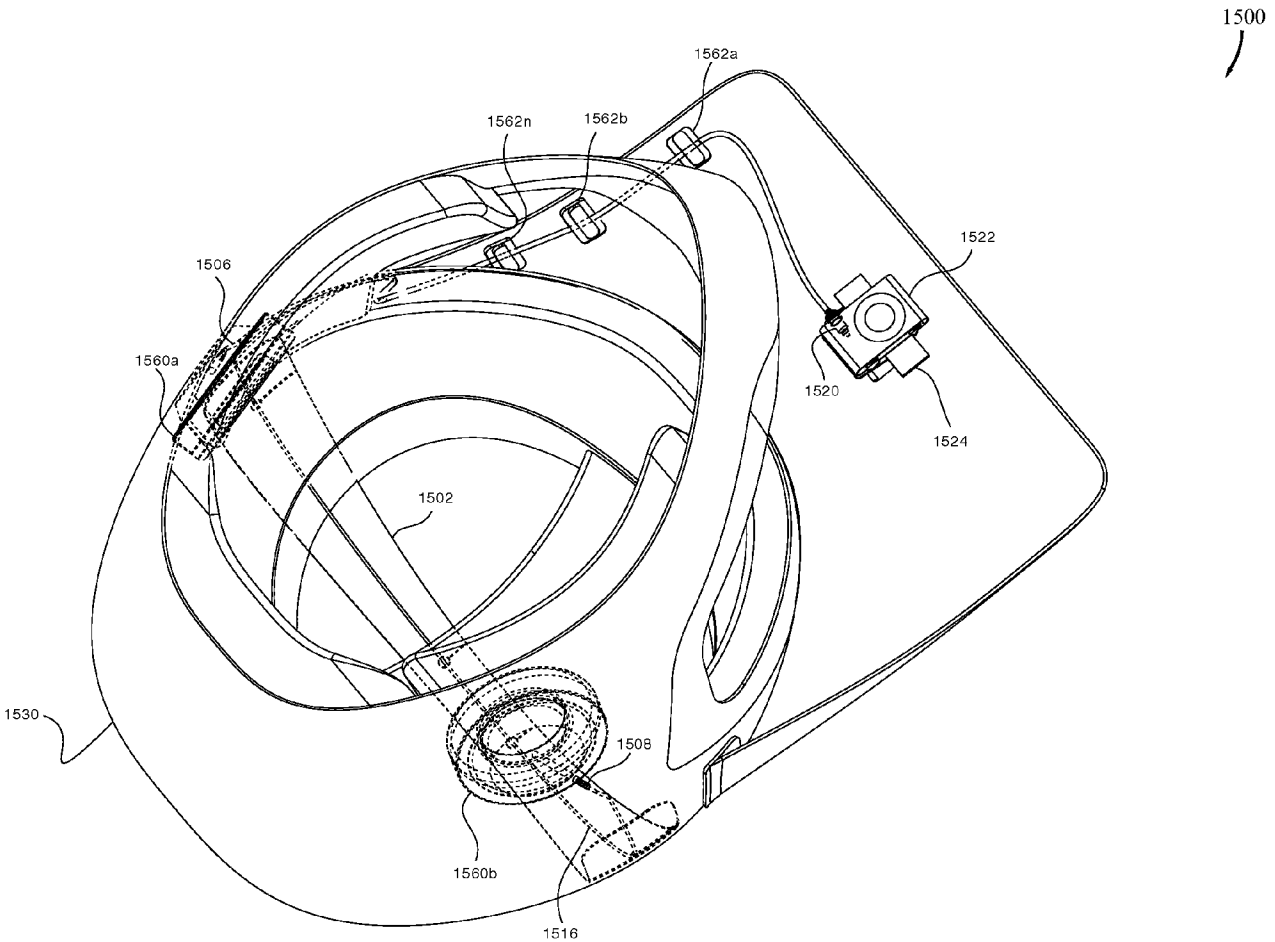
FIG. 15 is an additional diagram illustrating an exemplary listening device aid hidden within an article of clothing with earphones that cover a human ear attached to the article of clothing in which aspects of the present invention may be realized.

FIG. 15 is an additional diagram illustrating an exemplary listening device aid 1500 hidden within an article of clothing with earphones that cover a human ear attached to the article of clothing in which aspects of the present invention may be realized. FIG. 15 illustrates the combination of FIG. 1, FIG. 2, FIG. 13, and FIG. 14 and includes all of the embodiments described therein. FIG. 15 illustrates in an upside down view of a helmet device 1530 having the flexible strap 1502 being secured within the helmet 1530 that is mounted therein to the inner foam (not shown) in the helmet. The first headphone cord 1516 is routed through the flexible straps 1502 via opening holes/slits (not shown). A second headphone cord 1506, having a second length, is also connected to the earphone plug 1520.

A first earphone body 1560, which is large enough for surrounding and covering a human ear, is connected to the first headphone cord 1516 for converting the sound signals to audible sounds. The second earphone body (not shown), which is large enough for surrounding and covering a human ear, is connected to the second headphone cord 1506 for converting the sound signals to audible sounds. The first and second headphone cord 1516 and 1506 connect to the audio input connections 1508, which is used to connect to the earphone body 1560 (illustrated in FIG. 15 as 1560*a-b*). Since many helmets 1530 have large spaces for the human ear, this space may be used to place the first and second earphone body 1560 into these holes/openings within the helmet. The earphone bodies 1560 may be large headphone speakers and be bonded/secured to the inside of the helmet. As illustrated in FIG. 15, the earphone speaker 1560 is attached inside of the helmet and secured therein and remains in the fixed portion. Thus, the music listener may easily remove and put on the helmet 1530 while the flexible strap 1502 and the earphone speakers 1560 remain in a bonded/secured position. In addition, several hook and lock devices 1562 (illustrated in FIG. 15 as 1562*a-n*) are placed along the first headphone cord 1516 for hooking and locking the first headphone cord 1516 and then securing the first headphone cord 1516 to an helmet/hat via the hook and lock devices 1562. These hook and look devices 1562 clamp and pin down the first headphone cord 1516 and tightly secure the first headphone cord 1516 by a variety of locking/clamping mechanisms commonly known in the art. The hook and lock devices 1562 may also be bonded/secured to the helmet by the various methods, as described above, similar to the flexible strap (FIG. 1 102). Also, the media device 1522 is secured to the helmet via the additional flexible strap 1524.

Figure 16:
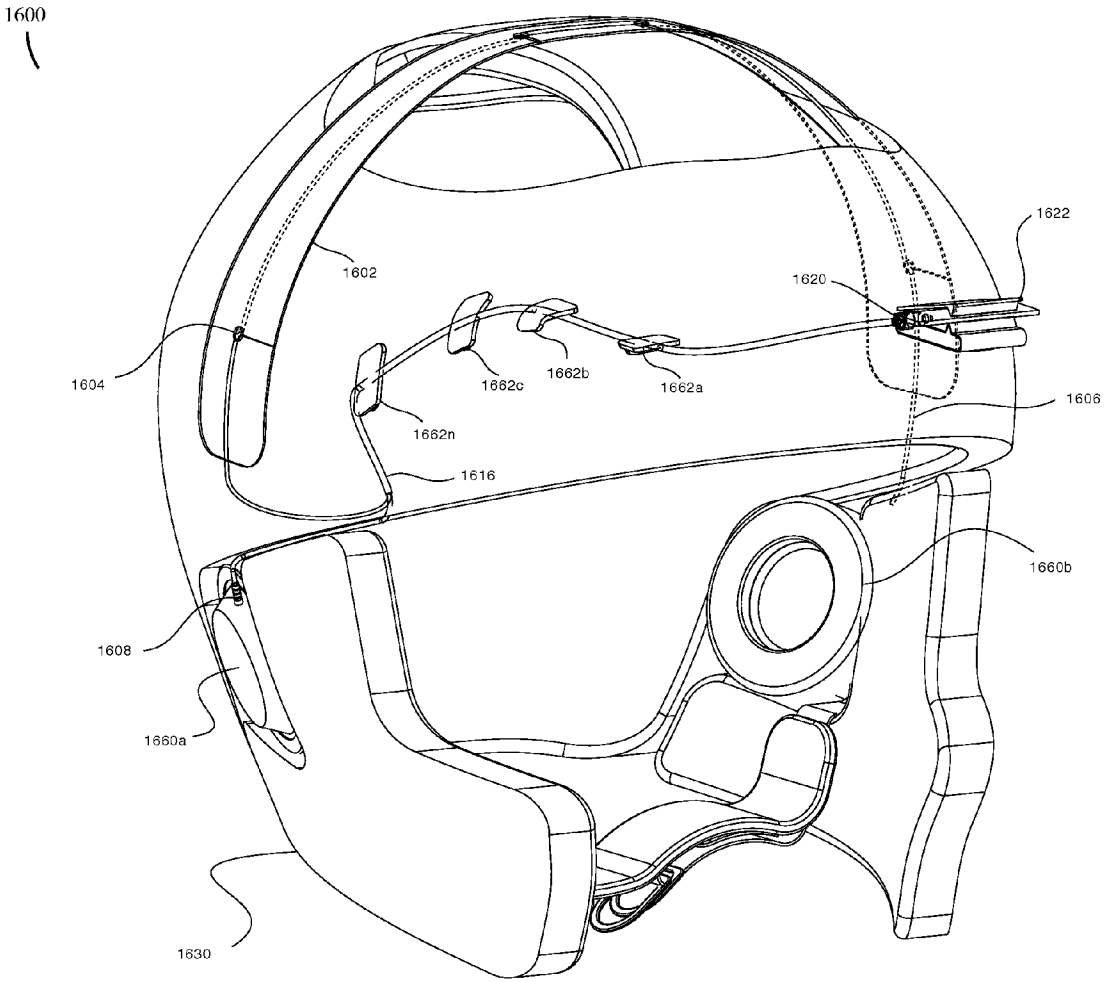
FIG. 16 is an additional diagram illustrating an exemplary front view of an article of clothing containing the listening device aid hidden within an article of clothing with earphones that cover a human ear attached to the article of clothing in which aspects of the present invention may be realized.

FIG. 16 is an additional diagram illustrating an exemplary front view of an article of clothing containing the listening device aid 1600 hidden within an article of clothing with earphones that cover a human ear attached to the article of clothing in which aspects of the present invention may be realized. FIG. 16 illustrates the combination of FIG. 1, FIG. 2, FIG. 13, FIG. 14, and FIG. 15 and includes all of the embodiments described therein. FIG. 16 illustrates an isometric view of a helmet device (external shell not shown) 1630 having the flexible strap 1602 being secured within the helmet 1630 that is mounted therein to the inner foam 1630 in the helmet. The flexible strap 1602 may be mounted directly inside of the shell of the helmet 1630, but outside of the internally placed foam of the helmet 1630. The openings 1604 are positioned in a variety of locations along the flexible strap 1602 and illustrate the first headphone cord 1616 (shown as solid and dotted lines) routed through the flexible straps 1602 via the opening holes/slits 1604. A second headphone cord 1606, having a second length, is also connected to the earphone plug 1620.

A first earphone body 1660*a* (e.g., headphone speaker), which is large enough for surrounding and covering a human ear, is connected to the first headphone cord 1616 for converting the sound signals to audible sounds. The second earphone body 1660*b*, which is large enough for surrounding and covering a human ear, is connected to the second headphone cord 1606 for converting the sound signals to audible sounds. The first and second headphone cord 1616 and 1606 connect to the audio input connections 1608, which is used to connect to the earphone bodies 1660. Since many helmets 1630 have large spaces for the human ear, this space may be used to place the first and second earphone body 1660 into these holes/openings within the helmet. The earphone bodies 1660 may be large headphone speakers and be bonded/secured to the inside of the helmet. As illustrated in FIG. 16, the earphone speaker 1660 is attached inside of the helmet and secured therein and remains in the fixed portion. Thus, the music listener may easily remove and put on the helmet 1630 while the flexible strap 1602 and the earphone speakers 1660 remain in a bonded/secured position. In addition, several hook and lock devices 1662 (illustrated in FIG. 16 as 1662*a-n*) are placed along the first headphone cord 1616 for hooking and locking the first headphone cord 1616 and then securing the first headphone cord 1616 to an helmet/hat via the hook and lock devices 1662. These hook and look devices 1662 clamp and pin down the first headphone cord 1616 and tightly secure the first headphone cord 1616 by a variety of locking/clamping mechanisms commonly known in the art. The hook and lock devices 1662 may also be bonded/secured to the helmet by the various methods, as described above, similar to the flexible strap (FIG. 1 102). As shown in FIG. 16, the hooking and locking devices 1662 may be connected along the back, front, face shield, and/or an attached visor of the helmet 1630. Also, the media device 1622 is secured to the helmet via a clip that is attached to the media device 1622. The helmet 1630 may have a visor attachment, but is removed from FIG. 16 for clarity. In one embodiment, the first headphone cord 1616 may be secured to the visor of the helmet 1630 via the hook and lock devices 1662.

Figure 17:
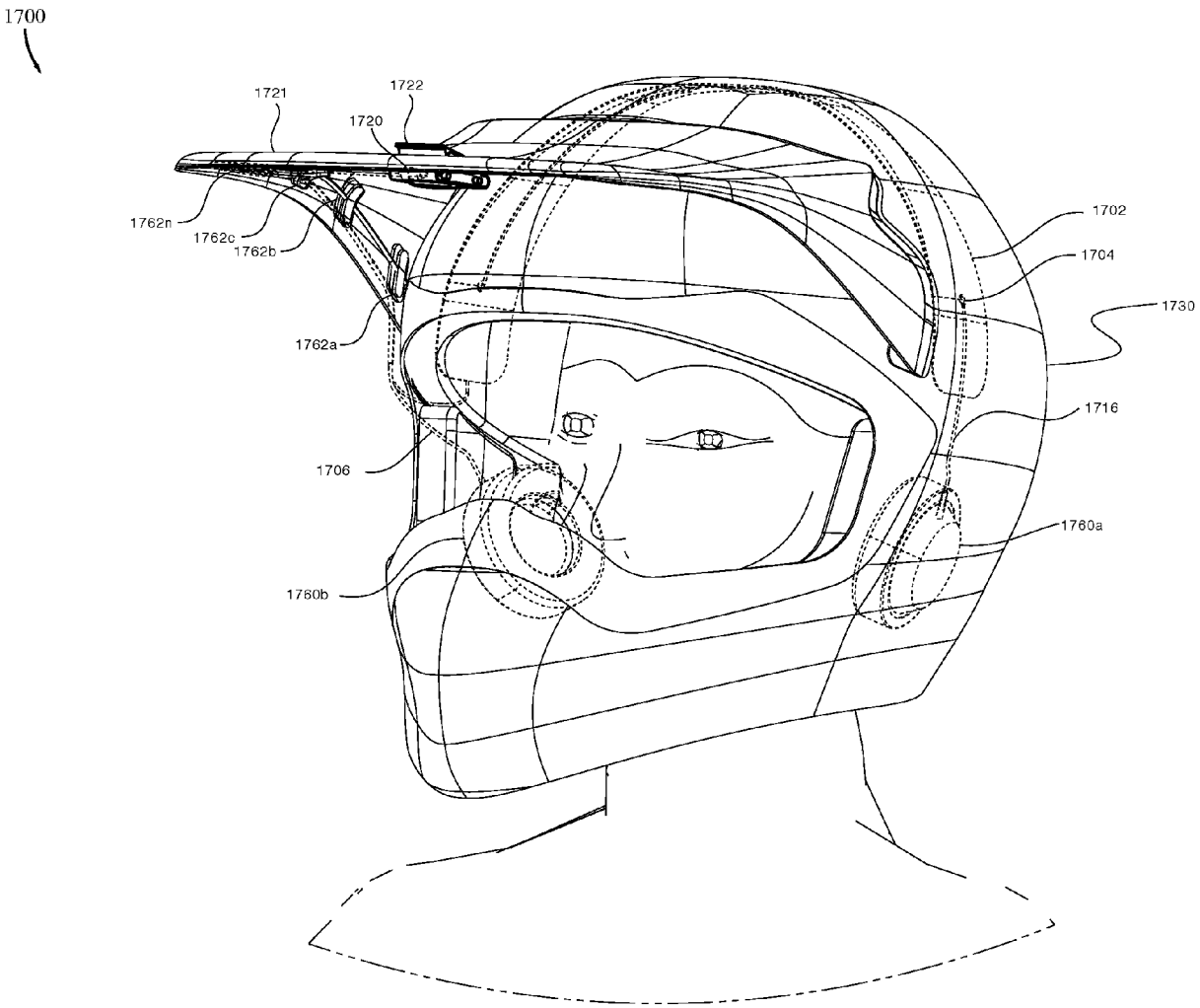
FIG. 17 is an additional diagram illustrating an exemplary side angle view of an article of clothing containing the listening device aid hidden within an article of clothing with earphones that cover a human ear attached to the article of clothing in which aspects of the present invention may be realized.

FIG. 17 is an additional diagram illustrating an exemplary side angle view of an article of clothing containing the listening device aid 1700 hidden within an article of clothing with earphones that cover a human ear attached to the article of clothing in which aspects of the present invention may be realized. FIG. 17 illustrates the combination of FIG. 1, FIG. 2, FIG. 13, FIG. 14, FIG. 15, and FIG. 16 and includes all of the embodiments described therein. FIG. 17 illustrates an isometric side view of a helmet device 1730 having the flexible strap 1702 being secured within the helmet 1730 that is mounted therein to the inner foam (not shown) in the helmet. The flexible strap 1702 may be mounted directly inside of the shell of the helmet 1730, but outside of the foam of the helmet 1730. The openings 1704 are positioned in a variety of locations along the flexible strap 1702 and illustrate the first headphone cord 1716 routed through the flexible straps 1702 via the opening holes/slits 1704. A second headphone cord 1706, having a second length, is also connected to the earphone plug 1720.

A first earphone body 1760*a* (e.g., headphone speaker), which is large enough for surrounding and covering a human ear, is connected to the first headphone cord 1716 for converting the sound signals to audible sounds. The second earphone body 1760*b*, which is large enough for surrounding and covering a human ear, is connected to the second headphone cord 1706 for converting the sound signals to audible sounds. Since many helmets 1730 have large spaces for the human ear, this space may be used to place the first and second earphone body 1760 into these holes/openings within the helmet 1730. The earphone body 1760 may be large headphone speakers and be bonded/secured to the inside of the helmet. As illustrated in FIG. 17, the earphone speakers 1760 are attached inside of the helmet and secured therein and remain in the fixed portion. Thus, the music listener may easily remove and put on the helmet 1730 while the flexible strap 1702 and the earphone speakers 1760 remain in a bonded/secured position. In addition, several hook and lock devices 1762 (illustrated in FIG. 17 as 1762*a-n*) are placed along the first headphone cord 1716 for hooking and locking the first headphone cord 1716 and then securing the first headphone cord 1716 to an helmet/hat via the hook and lock devices 1762. These hook and look devices 1762 clamp and pin down the first headphone cord 1716 and tightly secure the first headphone cord 1716 by a variety of locking/clamping mechanisms commonly known in the art. The hook and lock devices 1762 may also be bonded/secured to the helmet by the various methods, as described above, similar to the flexible strap (FIG. 1 102). As shown in FIG. 17, the hooking and locking devices 1762 are connected along the visor portion 1721 of the helmet 1730. Also, the media device 1722 is secured to the visor portion 1721 of the helmet 1730 via a clip that is attached to the media device 1722.

Figure 18:
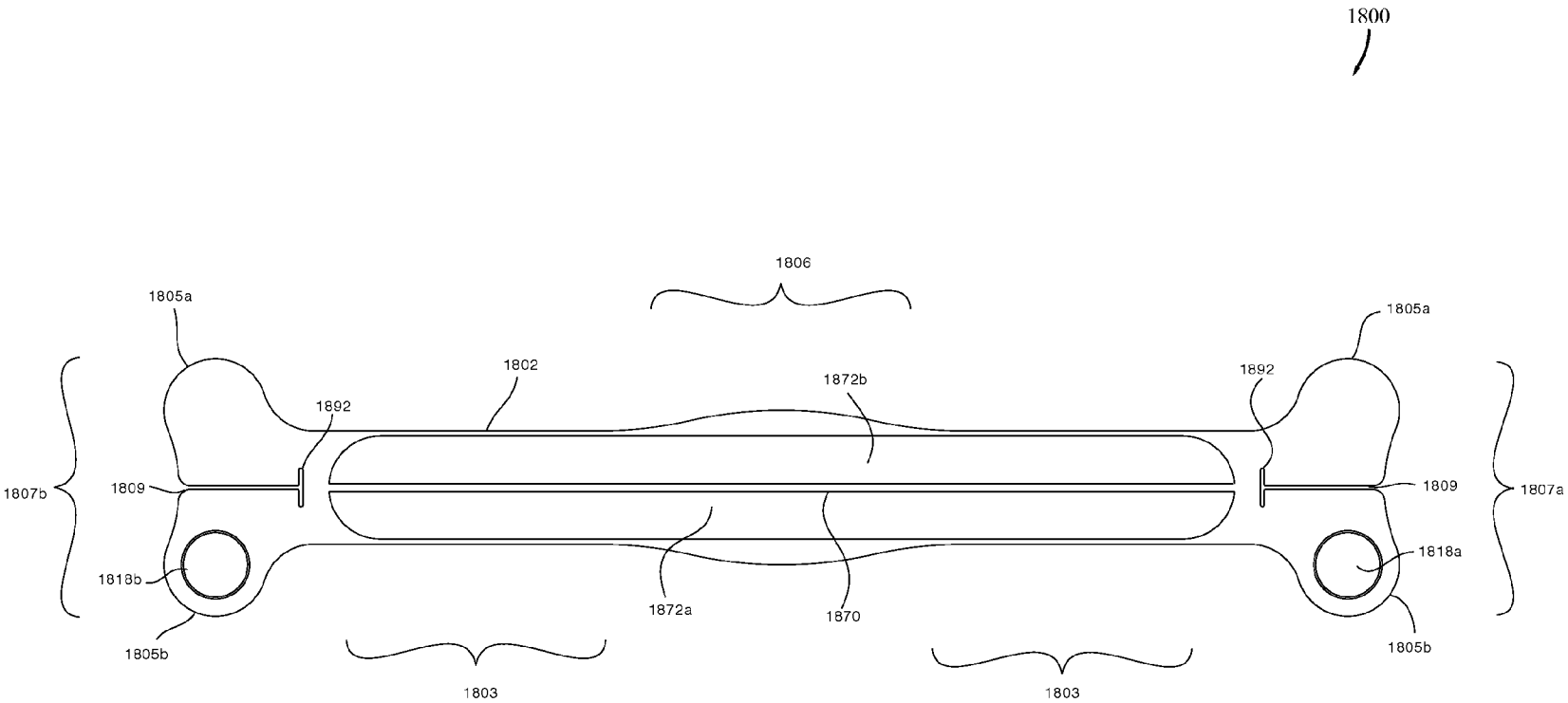
FIG. 18 is an additional diagram illustrating an exemplary flexible strap device having a channel structure for receiving and retaining earphone cords in which aspects of the present invention may be realized.

FIG. 18 is an additional diagram illustrating an exemplary flexible strap device 1800 having a channel structure for receiving and retaining earphone cords in which aspects of the present invention may be realized. In FIG. 18, the flexible strap 1802 may be of a variety of lengths, shapes and sizes based on the various articles of clothing that would be worn on the head requires. The flexible strap 1802 may be straight, curved, angled, and/or formed to a variety of geometric shapes or positions for being secured and/or hidden within the various articles of clothing that would be worn on the head (e.g. a baseball hat, helmet, wig, and/or visor). For example, the portions 1803 along the sides (which are illustrated in FIG. 18 by combining 1803 and 1806) of the flexible strap 1802 may be concave or convex (shown in the FIG. 18 as concave) and the center portion 1806 may be also concave, convex, or form a variety of geometric shapes and sizes (shown in FIG. 18 as convex). In FIG. 18, the flexible strap 1802 illustrates the center portion as having an elongated oval shape. The thickness, depth, and/or width of the flexible strap may vary according to the type of article of clothing. For example, in a baseball type hat the flexible strap may be relatively thin (e.g., less than a millimeter in thickness) and for a motorcycle helmet the flexible strap may be designed with a thicker dimension (e.g., 3 millimeters) for more stability and strength. However, the thickness may also be based upon user preferences and vary accordingly. The flexible strap 1802 may be comprised of a variety of materials, such as a plastic substance, carbon fibers, polyurethane material, synthetic polymer material, cushioning material, fibrous materials, rubber materials, glass, elastic materials, flexible materials (e.g., a flexible membrane), cork, foam, metallic materials and/or other material or combination of materials known in the art, which are suitable for such an application. The flexible strap 1802 may have and adhesive type material applied to any portion thereof and the adhesive material may include, but not limited to, tape, glue, buttons, clips, suction cups, Velcro®, a heat seal, reactive/non-reactive and/or natural synthetic type adhesives, and/or any type of substance known in the art that unites, bonds, secures, fastens, and/or sticks to the article of clothing or protective device for the head. For example, the flexible strap 1802 may have a sticky, glue-like substance that is applied to an underneath portion of the flexible strap for sticking the flexible strap 1802 to a helmet. The flexible strap 1802 has an ending 1807 that forms a right foot 1805 and a left foot 1805. The end portions 1807 (shown as 1807*a* for the right foot and 1807*b* for the left foot) of each of the right foot 1805 and the left foot 1805 may be concave thereby having the end points 1807 of the right foot 1805 and the left foot 1805 extends to a rounded point. FIG. 18 illustrates the right foot 1805 having a slit 1809 placed directly in the center of the ending 1807 thereby creating two symmetrical ends of the foot with a top portion being labeled as 1805*a* and a bottom portion being labeled as 1805*b* of the foot. Similarly, FIG. 18 illustrates the left foot 1805 having a slit 1809 placed directly in the center of the ending 1807 thereby creating two symmetrical ends of the foot 1805 with a top portion being labeled as 1805*a* and a bottom portion being labeled as 1805*b* of the foot. Both the right foot 1805 and the left foot 1805 may be manipulated within an article of clothing for securing, hiding, providing stability and support, and attaching the flexible strip to the article of clothing (e.g., a baseball cap, helmet, and/or visor). The right foot 1805 and the left foot 1805 of the flexible strap operate as a stabilizing foot and/or end piece for placement in an interior structure of the article of clothing. The slits 1809 provide for greater flexibility and stability by allowing each part of the foot 1805*a* and 1805*b* to be independently manipulated for securing the flexible strap 1802 to the article of clothing. Slit 1809 and slits 1892 may also be used to wedge and hold the headphone/earphone speaker wires in a secured and locked position. The slits 1809 also allow any size speakers to be used where a hole without a slit limits the speaker size. Such a design of the flexible strap 1800 allows for the use of wireless communication devices. For example, a user may use their own, personal earphone, and even use Bluetooth speaker wires designed to run around the back of a person's neck.

Moreover, the flexible strap 1802 also contains a channel structure 1870 running the length of the flexible strap for allowing excess earphone cord (not shown) to be placed and received in the channel structure 1870. The channel structure 1870 provides a secure cavity for retaining and hiding the excess earphone cord. Furthermore, directly over and above the channel structure 1870 are two independent molded seals 1872*a* and 1872*b* to be flexed and adjusted for securing and retaining the earphone/headphone cord. The molded seals 1872*a* and 1872*b* may be bent and manipulated for allowing the earphone cords to be slid into the channel structure 1870 and secured within the channel structure 1870. Upon the molded seals 1872*a* and 1872*b* returning to the un-manipulated state, the molded seals 1872*a* and 1872*b* close together forming a barrier thereby preventing the earphone cords from sliding out of the channel structure 1870 in the flexible strap 1802. The flexible strap 802 also includes slots 818 (e.g., circular openings/groves that are illustrated in FIG. 18 as 1818*a* and 1818*b*) for receiving magnets. The magnets included in the slots 1818 allow for earphone speakers/headphone speakers to be secured to the magnets when not in use in a person's ear. In FIG. 18, the magnet cavity 1818 is illustrated with two circular shapes for receiving the magnets. These slots 1818 may also be covered with slits or molded seals (not shown) for securing the magnets to the flexible strap.

Figure 19:
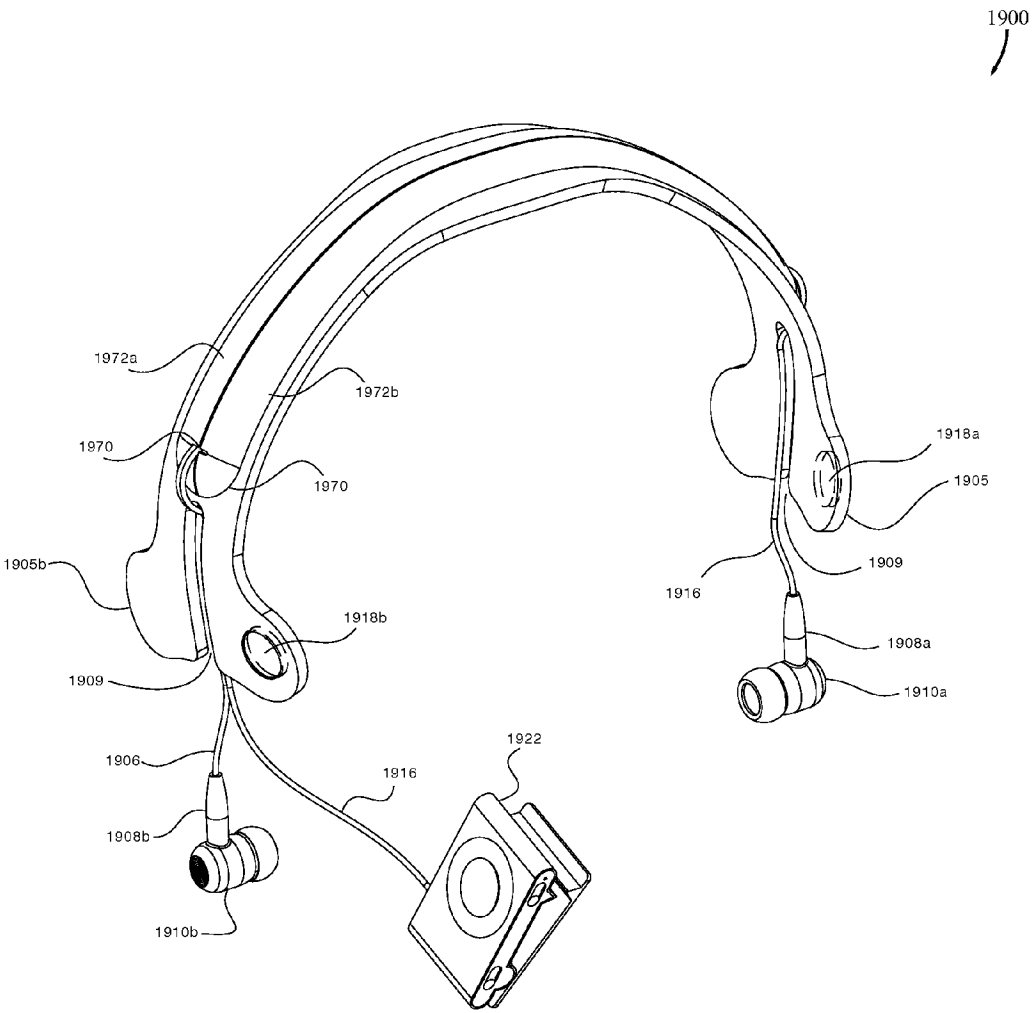
FIG. 19 is a diagram illustrating an exemplary listening device aid with a channel structure for receiving and retaining earphone cords in which aspects of the present invention may be realized.

FIG. 19 is a diagram illustrating an exemplary listening device aid with a channel structure for receiving and retaining earphone cords in which aspects of the present invention may be realized. In FIG. 19, the flexible strap 1902 may be of a variety of lengths, shapes and sizes based on the various articles of clothing that would be worn on the head requires. FIG. 19 illustrates flexible strap 1902 having a slit 1909 placed directly in the center of an ending portion of the flexible strap 1902 thereby creating two symmetrical ends of the flexible strap 1902. Similarly, FIG. 19 illustrates the left foot 1905 and a right foot 1905 (labeled in FIG. 19 as 1905*a-b*) having a slit 1909 placed directly in the center of the ending of the flexible strap 1902 thereby creating two symmetrical ends of the foot 1905*a* and 1905*b*. Both the right foot 1905 and the left foot 1905 may be manipulated within an article of clothing for securing, hiding, providing stability and support, and attaching the flexible strip to the article of clothing (e.g., a baseball cap, helmet, and/or visor). The right foot 1905 and the left foot 1905 of the flexible strap operate as a stabilizing foot and/or end piece for placement in an interior structure of the article of clothing. The slits 1909 provide for greater flexibility and stability by allowing each part of the foot 1905*a* and 1905*b* to be independently manipulated for securing the flexible strap 1902 to the article of clothing. The slits 1909 may also be used to wedge and hold the headphone/earphone speaker wires. Such a design of the flexible strap 1900 allows for the even the use of wireless communication devices. For example, a user may use their own earphone cords and even use Bluetooth speaker wires designed to run around the back of a person's neck.

A first earphone body 1910*a* is connected to the first headphone cord 1916 for converting the sound signals to audible sounds. The second earphone body 1910*b* is connected to the second headphone cord 1906 for converting the sound signals to audible sounds. The first earphone body 1910*a* and the second earphone body 1910*b* are shaped to be retained in one of a concha cavity of a human ear and the article of clothing. The first headphone cord 1916 is coupled to the second earphone body 1910*b* with an attachment point 1908 such that the second earphone body 1910*b* is lower than the attachment point 1908. The first headphone cord 1916 is also connected to the audio/media device 1922.

Moreover, the flexible strap 1902 also contains a channel structure 1970 running the length of the flexible strap for allowing excess earphone cord (not shown) to be placed and received in the channel structure 1970. The channel structure 1970 provides a secure cavity for retaining and hiding the excess earphone cord. Furthermore, directly over and above the channel structure 1970 are two independent molded seals 1972*a* and 1972*b* to be flexed and adjustable for securing and retaining the earphone/headphone cord. The molded seals 972*a* and 1972*b* may be bent and manipulated for allowing the earphone cords to be slid into the channel structure 1970 and secured within the channel structure 1970. Upon the molded seals 1972*a* and 1972*b* returning to the un-manipulated state, the molded seas 1972*a* and 1972*b* close together forming a barrier thereby preventing the earphone cords from sliding out of the channel structure 1970 in the flexible strap 1902. In FIG. 19, the flexible strap 1902 illustrates a configuration for using long speaker wires. In one embodiment, once the long speaker wires leave an audio/media device 1922, the earphone cords 1916 and 1906 are both routed into a channel cavity 1970. Thus, the first earphone cord 1916 is routed to one of the sides (e.g., the right side of the flexible strap 1902) and the second earphone cord 1902 is routed to the other side (e.g., the left side of the flexible strap 1902).

The flexible strap 1902 also includes slots 1918 (e.g., circular openings/groves illustrated in FIG. 19 as 1918*a* and 1918*b*) for receiving magnets. The magnets included in the slots 1919 allow for earphone speakers/headphone speakers to be secured by the magnets when not in use in a person's ear. In FIG. 19, the magnet cavity 1918 is illustrated as two circular shapes in the flexible strap 1902.

Figure 20:
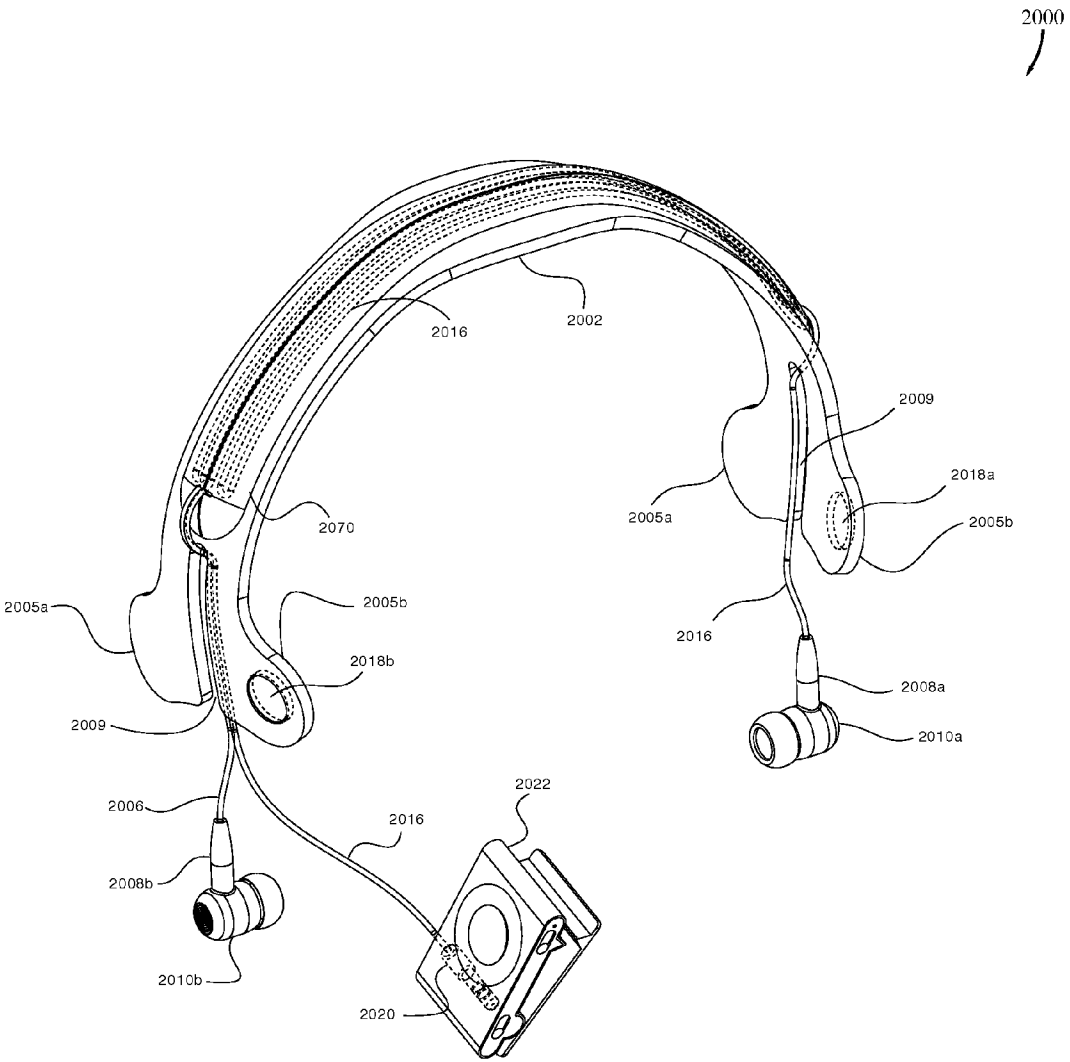
FIG. 20 is an additional diagram illustrating an exemplary listening device aid with a channel structure for receiving and retaining earphone cords in which aspects of the present invention may be realized.

FIG. 20 is an additional diagram illustrating an exemplary listening device aid 2000 with a channel structure for receiving and retaining earphone cords in which aspects of the present invention may be realized. In FIG. 20, the flexible strap 2002 has an ending of the flexible strap 2002 that forms a right foot 2005 and a left foot 2005. The end portion of each of the right foot 2005 and the left foot 2005 may be rounded, semi-circular end points of the flexible strap 2002. FIG. 20 illustrates the right foot 2005 having a slit 2009 placed directly in the center of the ending of the flexible strap 2002 thereby creating two symmetrical ends (illustrated as 2005*a* and 2005*b* to show the two symmetrical, rounded, semi-circular ends of the flexible strap 2002) of the foot 2005. Similarly, FIG. 20 illustrates the left foot 2005 having a slit 2009 placed directly in the center of the ending of the flexible strap 2002 thereby creating two symmetrical ends of the foot 2005. Both the right foot 2005 and the left foot 2005 may be manipulated within an article of clothing for securing, hiding, providing stability and support, and attaching the flexible strip to the article of clothing (e.g., a baseball cap, helmet, and/or visor). The right foot 2005 and the left foot 2005 of the flexible strap 2002 operate as a stabilizing foot and/or end piece for placement in an interior structure of the article of clothing. The slits 2009 provide for greater flexibility and stability by allowing each part of the foot 2005*a* and 2005*b* to be independently manipulated for securing the flexible strap 2002 to the article of clothing. The slit 2009 may also be used to wedge and hold the headphone/earphone speaker wires in a secured and locked position. Such a design of the flexible strap 2000 allows for the even the use of wireless communication devices. For example, a user may use their own earphone cords and even use Bluetooth speaker wires designed to run around the back of a person's neck.

A first earphone body 2010*a* is connected to the first headphone cord 2016 for converting the sound signals to audible sounds. The second earphone body 2010*b* is connected to the second headphone cord 2006 for converting the sound signals to audible sounds. The first earphone body 2010*a* and the second earphone body 2010*b* are shaped to be retained in one of a concha cavity of a human ear and the article of clothing. The first headphone cord 2016 is coupled to the second earphone body 2010*b* with an attachment point 2008 such that the second earphone body 2010*b* is lower than the attachment point 2008. The first headphone cord 2016 is also connected to the audio/media device 2022 via earphone plug 2020.

Moreover, the flexible strap 2002 also contains a channel structure 2070 running the length of the flexible strap for allowing, excess earphone cord (not shown) to be placed and received in the channel structure 2070. The channel structure 2070 provides a secure cavity for retaining and hiding the excess earphone cord. Furthermore, directly over and above the channel structure 2070 are two independent molded seals 2072*a* and 2072*b* to be flexed and adjustable for securing and retaining the earphone/headphone cord. The molded seals 2072*a* and 2072*b* may be bent and manipulated for allowing the earphone cords to be slid into the channel structure 2070 and secured within the channel structure 2070. Upon the molded, seals 2072*a* and 2072*b* returning to the un-manipulated state, the molded seals 2072*a* and 2072*b* close together forming a barrier thereby preventing the earphone cords from sliding out of the channel structure 2070 in the flexible strap 2002. In FIG. 20, the flexible strap 2002 illustrates a configuration for using long speaker wires. In one embodiment, once the long speaker wires leave an audio/media device 2022, the earphone cords 2016 and 2006 are both routed into a channel cavity 2070. Thus, the first earphone cord 2016 is routed to one of the sides (e.g., the right side of the flexible strap 2002) and the second earphone cord 2002 is routed to the other side (e.g., the left side of the flexible strap 2002). The earphone cords 2016 and 2006 are both routed into the channel cavity 2070 and are illustrated in FIG. 20 as the dotted lines to demonstrate the longer earphone cords or standard length earphone cords being hidden, secured, and concealed within the channel cavity 2070.

The flexible strap 2002 also includes slots 2018 (e.g., circular openings/groves and shown in FIG. 20 as 2018*a* and 2018*b*) for receiving magnets. The magnets included in the slots 2018 allow for earphone speakers/headphone speakers to be secured by the magnets when not in use in a person's ear. In FIG. 20, the magnet cavity 2018 is illustrated as two circles.

Figure 21:
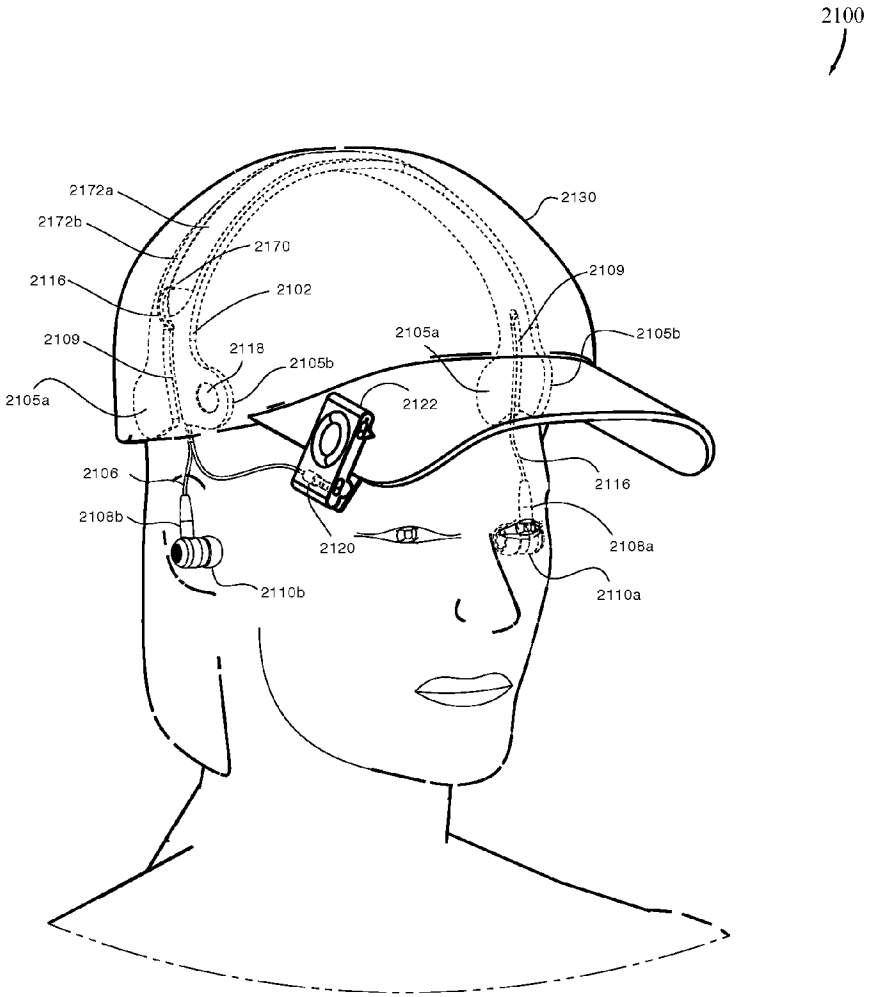
FIG. 21 is a diagram illustrating an exemplary listening device aid with a channel structure for receiving and retaining earphone cords in which aspects of the present invention may be realized.

FIG. 21 is a diagram illustrating an exemplary listening device aid with a channel structure for receiving and retaining earphone cords in which aspects of the present invention may be realized. FIG. 21 illustrates an isometric view showing a configuration on a human head. In FIG. 21, the flexible strap 2102 is placed internally within and secured within a hat 2130. In FIG. 21, the flexible strap 2102 has an ending of the flexible strap 2102 that forms a right foot 2105 and a left foot 2105. The end portion of each of the right foot 2105 and the left foot 2105 may be rounded, semi-circular end points of the flexible strap 2102. FIG. 21 illustrates the right foot 2105 having a slit 2109 placed directly in the center of the ending of the flexible strap 2102 thereby creating two symmetrical ends (illustrated as 2105*a* and 21005*b* to show the two symmetrical, rounded, semi-circular ends of the flexible strap 2102) of the foot 2105. Similarly, FIG. 21 illustrates the left foot 2105 having a slit 2109 placed directly in the center of the ending of the flexible strap 2102 thereby creating two symmetrical ends of the foot 2105. Both the right foot 2105 and the left foot 2105 may be manipulated within an article of clothing for securing, hiding, providing stability and support, and attaching the flexible strip to the article of clothing (e.g., a baseball cap, helmet, and/or visor). The right foot 2105 and the left foot 2105 of the flexible strap 2102 operate as a stabilizing foot and/or end piece for placement in an interior structure of the article of clothing. The slits 2109 provide for greater flexibility and stability by allowing each part of the foot 2105*a* and 2105*b* to be independently manipulated for securing the flexible strap 2102 to the article of clothing. The slit 2109 may also be used to wedge and hold the headphone/earphone speaker wires in a secured and locked position. Such a design of the flexible strap 2100 allows for the even the use of wireless communication devices. For example, a user may use their own earphone cords and even use Bluetooth speaker wires designed to run around the back of a person's neck.

A first earphone body 2110*a* is connected to the first headphone cord 2116 for converting the sound signals to audible sounds. A second earphone body 2110*b* is connected to a second headphone cord 2106 for converting the sound signals to audible sounds. The first earphone body 2110*a* and the second earphone body 2110*b* are shaped to be retained in one of a concha cavity of a human ear and the article of clothing. The first headphone cord 2116 is coupled to the first earphone body 2110*a* with an attachment point 2108 such that the second earphone body 2110*b* is lower than the attachment point 2108. The first headphone cord 2116 is also connected to the audio/media device 2122. As illustrated in FIG. 21, the first earphone body 2110*a* and the second earphone body 2110*b* are placed and inserted into the users ear.

Moreover, the flexible strap 2102 also contains a channel structure 2170 running the length of the flexible strap for allowing excess earphone cord (not shown) to be placed and received in the channel structure 2170. The channel structure 2170 provides a secure cavity for retaining and hiding the excess earphone cord. Furthermore, directly over and above the channel structure 2170 are two independent molded seals 2172*a* and 2172*b* to be flexed and adjustable for securing and retaining the earphone/headphone cord. The molded seals 172*a* and 2172*b* may be bent and manipulated for allowing the earphone cords to be slid into the channel structure 2170 and secured within the channel structure 2170. Upon the molded seals 2172*a* and 2172*b* returning to the un-manipulated state, the molded seals 2172*a* and 2172*b* close together forming a barrier thereby preventing the earphone cords from sliding out of the channel structure 2170 in the flexible strap 2102. The flexible strap 2102 also includes slots 2118 (e.g., circular openings/groves and shown in FIG. 21 as 2118*a* and 2118*b*) for receiving magnets. The magnets included in the slots 2118 allow for earphone speakers/headphone speakers to be secured by the magnets when not in use in a person's ear. In FIG. 21, the magnet cavity 2118 is illustrated as two circles. The first headphone cord 2116 is also connected to the audio/media device 2122 via earphone plug 2120. The audio/media device 2122 is connected to a brim portion of the hat as illustrated in FIG. 21.

Figure 22:
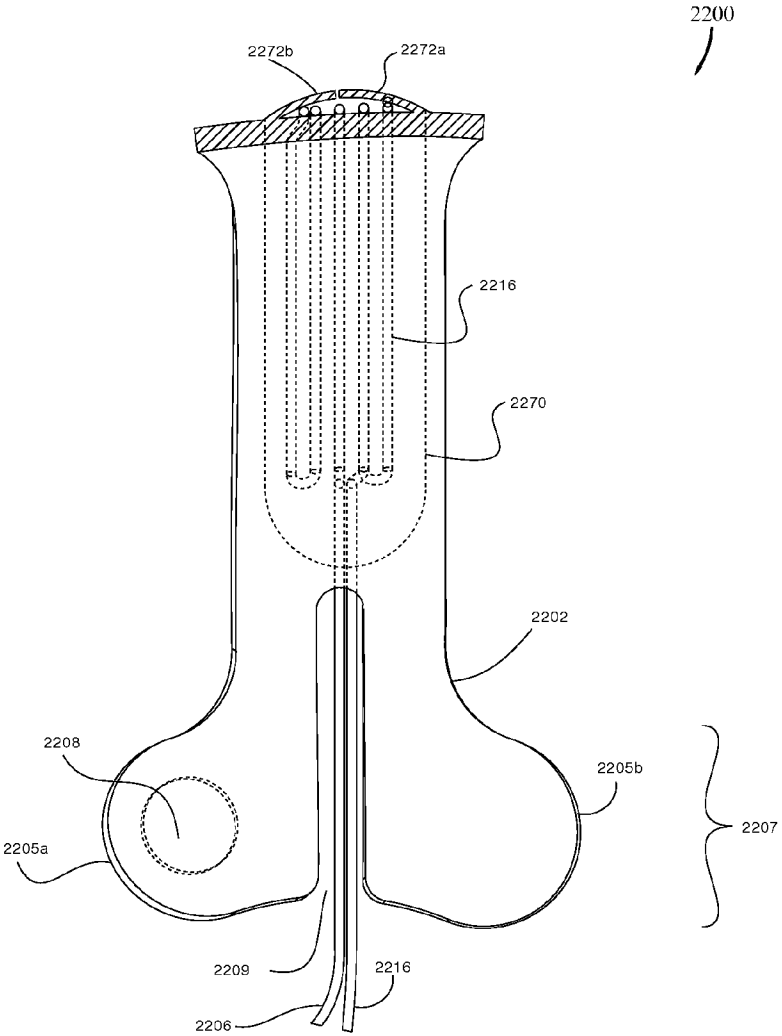
FIG. 22 is an additional diagram illustrating an exemplary flexible strap device having a channel structure for receiving and retaining earphone cords with earphone cords hidden within the channel structure in which aspects of the present invention may be realized.

FIG. 22 is an additional diagram illustrating an exemplary flexible strap device 2200 having a channel structure for receiving and retaining earphone cords with earphone cords hidden within the channel structure in which aspects of the present invention may be realized. FIG. 22 illustrates a side view of the flexible strap device 2200. A flexible strap 2202 has an ending 2207 that forms a foot 2205. The end portion (shown as 2205*a* and 2205*b*) of the foot 2205 may be rounded, semi-circular end points (or other geometric shapes and sizes) of the flexible strap. FIG. 22 illustrates the foot 2205 having a slit 2209 placed directly in the center of the ending 2207 thereby creating two symmetrical ends (illustrated in FIG. 22 as 2205*a* and 2205*b*) of the foot of the flexible strap 2202. The foot 2205 may be manipulated within an article of clothing for securing, hiding, providing stability and support, and attaching the flexible strip to the article of clothing (e.g., a baseball cap, helmet, and/or visor). The foot 2205 of the flexible strap 2202 operates as a stabilizing foot and/or end piece for placement in an interior structure of the article of clothing. The slit 2209 provide for greater flexibility and stability by allowing each part of the foot 2205*a* and 2205*b* to be independently manipulated for securing the flexible strap 2202 to the article of clothing. The slit 2209 may also be used to wedge and hold the headphone/earphone speaker wires. Such a design of the flexible strap device 2200 allows for the even the use of wireless communication devices. For example, a user may use their own earphone cords and even use Bluetooth speaker wires designed to run around the back of a person's neck.

The flexible strap 2202 also contains a channel structure 2270 running the length of the flexible strap for allowing excess earphone cord (not shown) to be placed and received in the channel structure 2270. The channel structure 2270 provides a secure cavity for retaining and hiding the excess earphone cord. Furthermore, directly over and above the channel structure 2270 are two independent molded seals 2272*a* and 2272*b* to be flexed and adjustable for securing and retaining the earphone/headphone cord. The molded seals 2272*a* and 2272*b* may be bent and manipulated for allowing the earphone cords to be slid into the channel structure 2270 and secured within the channel structure 2270. Upon the molded seals 2272*a* and 2272*b* returning to the un-manipulated state, the molded seals 2272*a* and 2272*b* close together forming a barrier thereby preventing the earphone cords from sliding out of the channel structure 2270 in the flexible strap 2202. In FIG. 22, the flexible strap 2202 illustrates a configuration for using long speaker wires. In one embodiment, once the long speaker wires leave an audio/media device, the earphone cords 2216 and 2206 are both routed into a channel cavity 2270. Thus, the first earphone cord 2216 is routed to one of the sides (e.g., the right side of the flexible strap 2202) and the second earphone cord 2202 is routed to the other side (e.g., the left side of the flexible strap 2202). The earphone cords 2216 and 2006 are both routed into the channel cavity 2270 and are illustrated in FIG. 22 as the dotted lines to demonstrate the earphone cords 2216 or standard length earphone cords being hidden, secured, and concealed within the channel cavity 2270.

Figure 23:
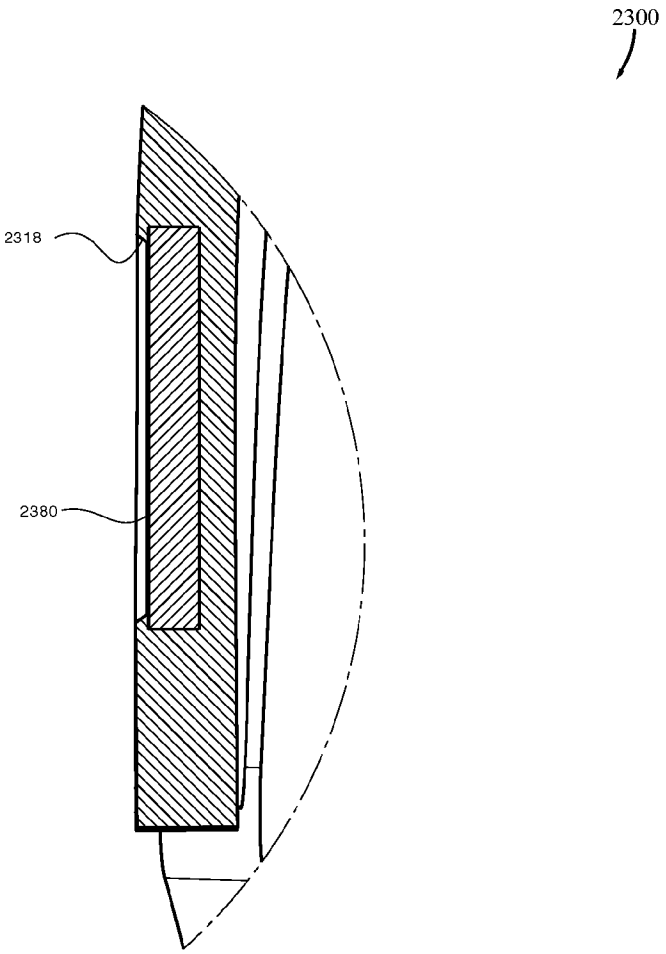
FIG. 23 is an additional diagram illustrating an exemplary cross section of a flexible strap device receiving and retaining a magnet in which aspects of the present invention may be realized.

FIG. 23 is an additional diagram illustrating an exemplary cross section of a flexible strap device 2300 receiving and retaining a magnet in which aspects of the present invention may be realized. The cross section shows the magnet 2380 secured and captured by the flexible rubber portion of the magnet cavity 2318 (c.r., FIG. 3 318). The magnet may be removed by flexing the rubber of the magnet cavity 2318 such that the magnet will pop out. However, the magnet cavity 2318 does not go all the way through a flexible strap (FIG. 1 102). Thus, in one embodiment, the magnet 2380 requires no adhesive material, and may be captured in the flexible rubber foot (FIG. 22 2205) of a flexible strap (FIG. 1 102) and be easily removed by a user.

Figure 24:
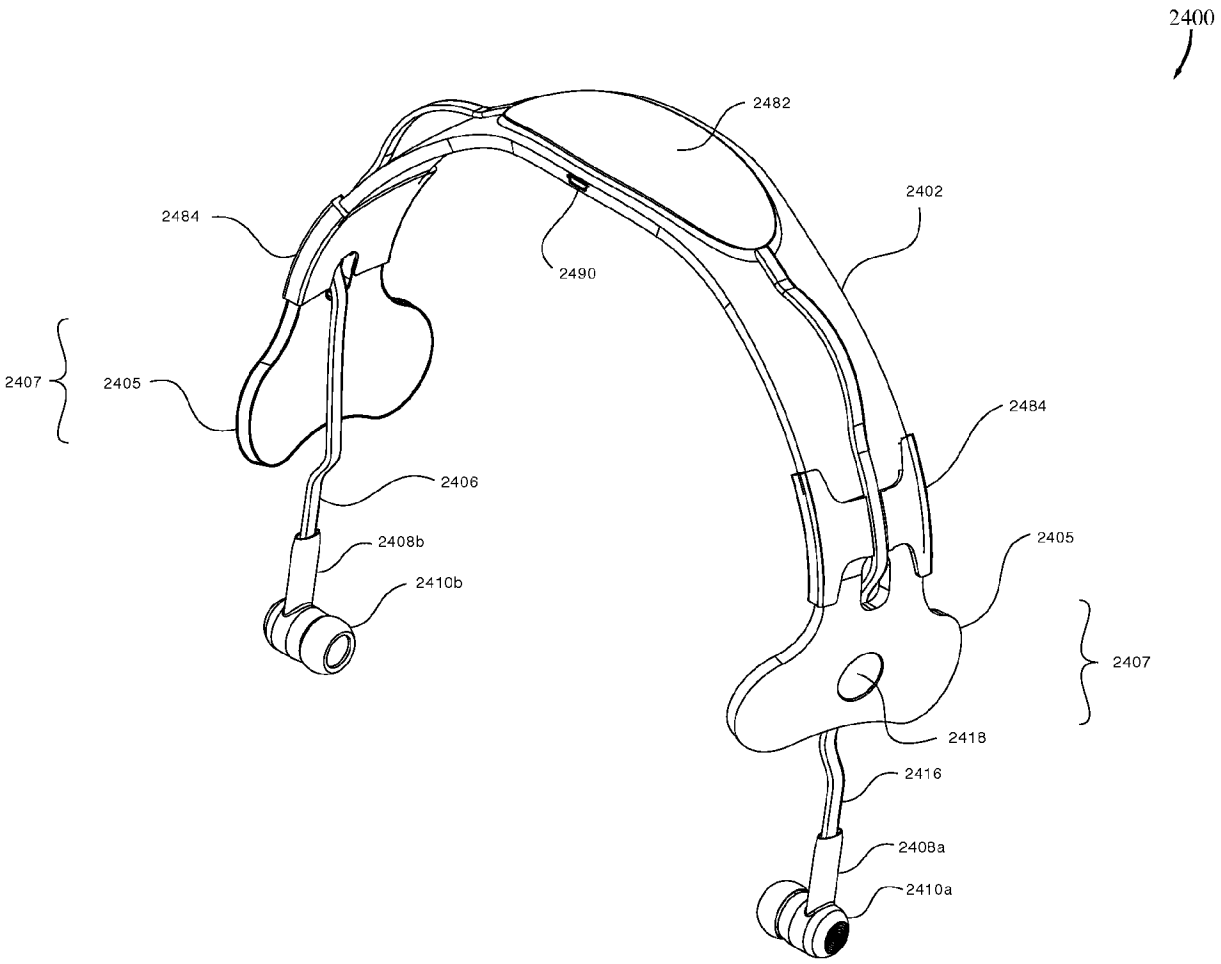
FIG. 24 is a diagram illustrating an exemplary listening device aid with a wireless communication system in which aspects of the present invention may be realized.

FIG. 24 is a diagram illustrating an exemplary listening device aid 2400 with a wireless communication system in which aspects of the present invention may be realized. FIG. 24 illustrates an isometric view showing an electronic circuit integrated therein for wireless communication with a host device, such as Bluetooth wireless configuration with a large ellipse on the top portion of the flexible strap 2402 to contain a battery pack 2482. In FIG. 24, the flexible strap 2402 may be of a variety of lengths, shapes and sizes based on the various articles of clothing that would be worn on the head requires. The flexible strap 2402 has an ending 2407 that forms a right foot 2405 and a left foot 2405. The end portions of each of the right foot 2405 and the left foot 2405 may be concave thereby having the end points 2407 of the right foot 2405 and the left foot 2405 extends to a rounded, semi-circular point (other geometric shapes may also be used). A first earphone body 2410*a* is connected to the first headphone cord 2416 for converting the sound signals to audible sounds. The second earphone body 2410*b* is connected to the second headphone cord 2406 for converting the sound signals to audible sounds. The first earphone body 2410*a* and the second earphone body 2410*b* are shaped to be retained in one of a concha cavity of a human ear and the article of clothing. The first headphone cord 2416 is coupled to the second earphone body 2410*b* with an attachment point 2408 such that the second earphone body 2410*b* is lower than the attachment point 2408. The first headphone cord 2416 and the second headphone cord 2406 are each connected to the battery pack and wireless chip circuitry 2482.

The flexible strap 2402 also includes slots 2418 (e.g., circular openings, groves, and/or magnet cavities illustrated in FIG. 24 as 2418*a* and 2418*b*) for receiving magnets. The magnets included in the slots 2418 allow for earphone speakers/headphone speakers to be secured by the magnets when not in use in a person's ear. In FIG. 24, the magnet cavity 2418 is illustrated as two circles.

As mentioned above, an electronic circuit may be integrated therein for wireless communication with a host device. In FIG. 24, in one embodiment, by way of example only, a Bluetooth wireless configuration is depicted on the top portion of the flexible strap 2402 to contain a battery pack and wireless chip circuitry 2482. Also a sliding lock mechanisms 2484 (shown as 2484*a* and 2484*b* in FIG. 24) is attached and coupled to the flexible strap 2402 for adjusting the length of the flexible strap 2402 and locking the newly adjusted flexible strap 2402 in position. The sliding lock mechanisms 2484 provides for independent control and adjustability to either side of the flexible strap 2402. Moreover, any size of speaker/earphone body 2410 may be used with the flexible strap 2402 since the strap may be detached and come apart. The speaker wires are built into a battery pack 2482 (e.g., a lithium battery pack/Bluetooth receiver and circuitry) and have additional slack allowing for the flexible strap 2402. A battery charger receptacle 2490 is built into either the battery pack 2482 and/or flexible strap 2402. Thus, with the wireless communication circuitry built in a audio/media device may be eliminated for wireless communication for receiving audio signals/music (e.g., the Bluetooth technology allows for listening to internet radio).

Figure 25:
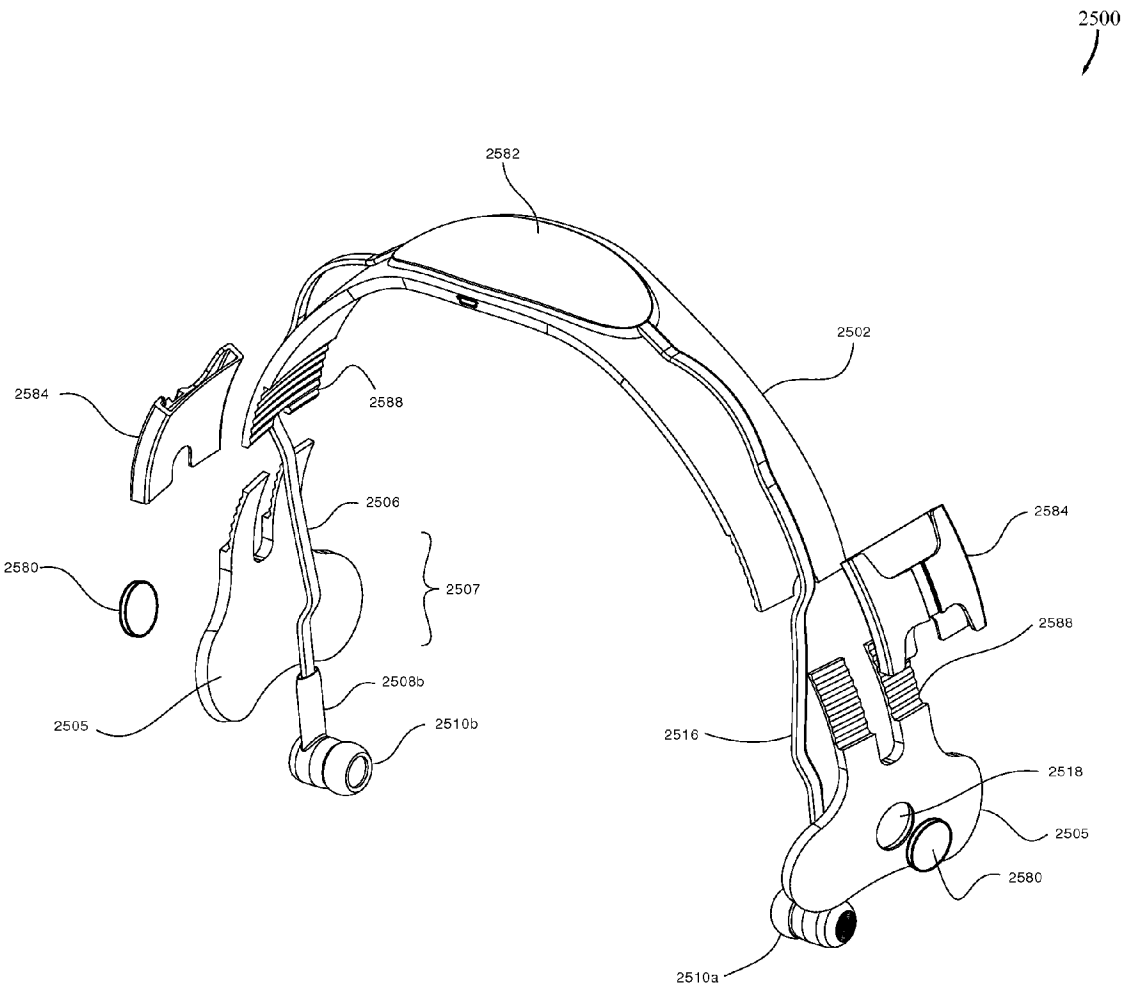
FIG. 25 is a diagram illustrating an exemplary listening device aid with an adjustable sliding lock mechanism in which aspects of the present invention may be realized.

FIG. 25 is a diagram illustrating an exemplary listening device aid 2500 with an adjustable sliding lock mechanism in which aspects of the present invention may be realized. FIG. 25 illustrates an exploded isometric view showing an electronic circuit integrated therein for wireless communication with a host device, such as Bluetooth wireless configuration with a large ellipse on the top portion of the flexible strap 2502 to contain a battery pack 2582. In FIG. 25, the flexible strap 2502 may be of a variety of lengths, shapes and sizes based on the various articles of clothing that would be worn on the head requires. The flexible strap 2502 has an ending 2507 that forms a right foot 2505 and a left foot 2505. The end portions of each of the right foot 2505 and the left foot 2505 may be concave thereby having the end points 2507 of the right foot 2505 and the left foot 2505 extends to a rounded, semi-circular point (other geometric shapes may also be used). A first earphone body 2510*a* is connected to the first headphone cord 2516 for converting the sound signals to audible sounds. The second earphone body 2510*b* is connected to the second headphone cord 2506 for converting the sound signals to audible sounds. The first earphone body 2510*a* and the second earphone body 2510*b* are shaped to be retained in one of a concha cavity of a human car and the article of clothing. The first headphone cord 2516 is coupled to the second earphone body 2510*b* with an attachment point 2508 such that the second earphone body 2510*b* is lower than the attachment point 2508. The first headphone cord 2516 and the second headphone cord 2506 are each connected to the battery pack and wireless chip circuitry 2582.

The flexible strap 2502 also includes slots 2518 (e.g., circular openings/groves and shown in FIG. 25 as 2518*a* and 2518*b*) for receiving magnets. The magnets 2580 included in the slots 2518 allow for earphone speakers/headphone speakers to be secured by the magnets 2580 when not in use in a person's ear. In FIG. 25, the magnet cavity 2518 is illustrated as two circular shapes in the flexible strap 2502.

As mentioned above, an electronic circuit is integrated therein for wireless communication with a host device. In FIG. 25, in one embodiment, for example, a Bluetooth wireless configuration is depicted with a large ellipse on the top portion of the flexible strap 2502 to contain a battery pack 2582. Also a sliding lock mechanisms 2584 (shown as 2584*a* and 2584*b* in FIG. 25) is attached and coupled to the flexible strap for adjusting the length of the flexible strap 2502 and locking the newly adjusted flexible strap 2502 in position. The adjustable speaker length provides for independent control and adjustability to either side of the flexible strap 2502. Furthermore, the sliding lock mechanisms 2584 may be locked and secured by a ribbed or teeth 2588 type design. The teeth 2588 allow for the sliding lock mechanisms 2584 to be clamped down, secured, and along the flexible strap 2502. The amount and length of the teeth 2588, which is built into the flexible strap 2502, may be of a variety of length. To adjust the speaker wire 2506 and 2516 length the speaker wire 2506 and 2516 is pulled through the sliding locking mechanism 2584 changing the slack. The sliding locking mechanism 2584 may be adjusted accordingly to accommodate the slack without removing the listening device aid 2500.

Moreover, any size of speaker/earphone body 2510 may be used with the flexible strap 2502 since the strap may be detached and come apart. The speaker wires are built into a battery pack 2582 (e.g., a lithium battery pack/Bluetooth receiver and circuitry) and have additional slack allowing independent adjustments to the relative height locations of the earphones 2510*a* and 2510*b* in regards to the user's left and right ears. A battery charger receptacle 2590 is built into either the battery pack 2582 and/or flexible strap 2502. Thus, with the wireless communication circuitry built in, a hard wired audio/media device may be eliminated in exchange for wireless communication by receiving audio signals/music (e.g., the Bluetooth technology allows for listening to internet radio).

Figure 26:
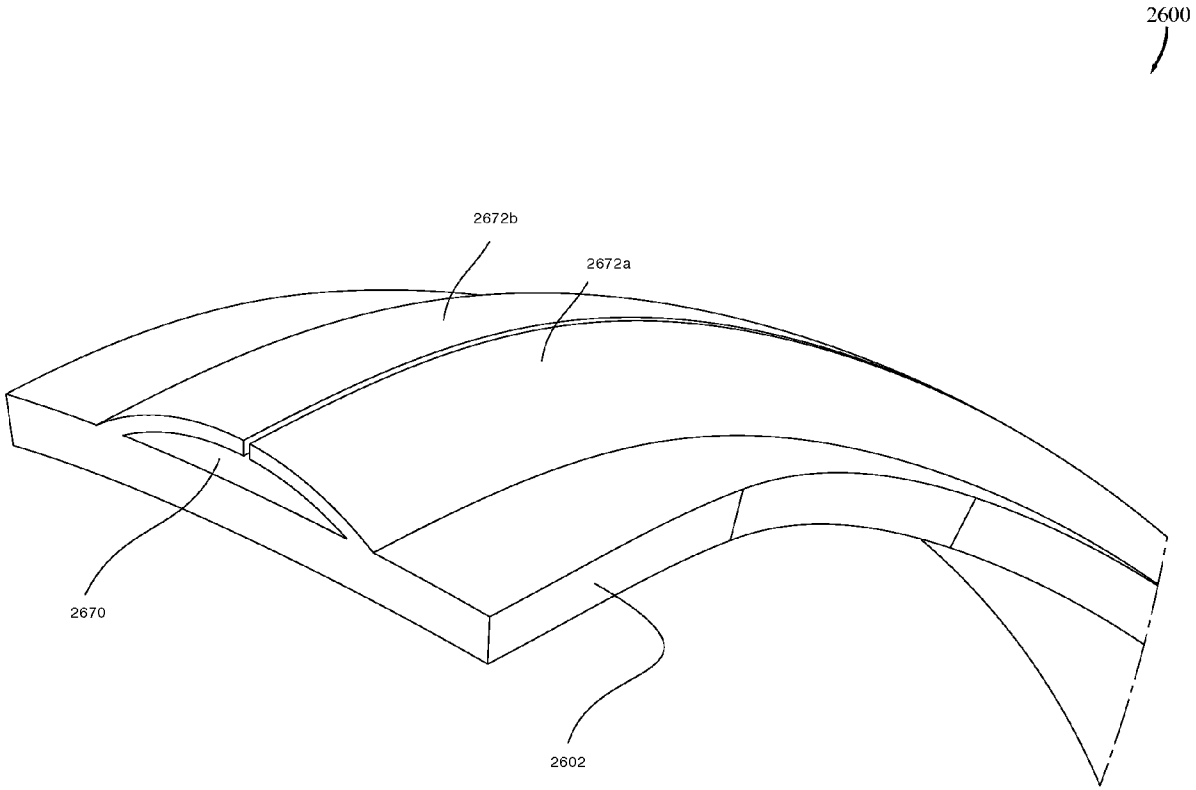
FIG. 26 is a diagram illustrating an exemplary channel structure with seals for receiving and retaining earphones within a flexible strap in which aspects of the present invention may be realized.

FIG. 26 is a diagram illustrating an exemplary channel structure with seals for receiving and retaining earphones within a flexible strap in which aspects of the present invention may be realized. The flexible device 2602 (as shown in FIG. 1 102 or FIG. 26 2602) contains a channel structure 2670 running the length of the flexible strap for allowing excess earphone cord (not shown) to be placed and received in the channel structure 2670. The channel structure 2670 provides a secure cavity for retaining and hiding the excess earphone cord. Furthermore, directly over and above the channel structure 2670 are two independent molded seals 2672*a* and 2672*b* to be flexed and adjustable for securing and retaining the earphone/headphone cord. The molded seals 2672*a* and 2672*b* may be bent and manipulated for allowing the earphone cords to be slid into the channel structure 2670 and secured within the channel structure 2670. Upon the molded seals 2672*a* and 2672*b* returning to the un-manipulated state, the molded seals 2672*a* and 2672*b* close together forming a barrier thereby preventing the earphone cords from sliding out of the channel structure 2670 in the flexible strap 2602. The molded seals 2672 allow for the user to flex open and pack speaker wires into the channel structure 2670.

Figure 27:
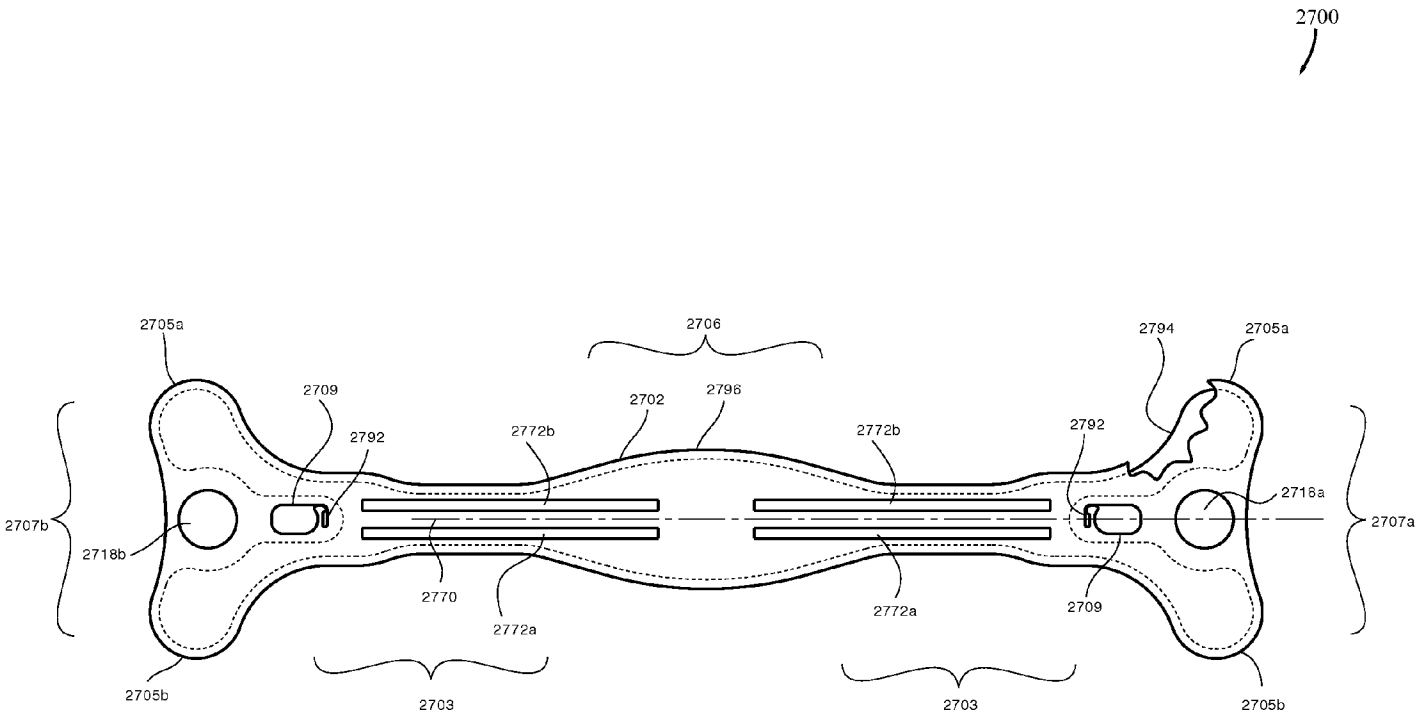
FIG. 27 is a diagram illustrating an exemplary listening device aid in which aspects of the present invention may be realized.

FIG. 27 is an additional diagram illustrating an exemplary listening device with a semi-rigid strap device 2700 having an external flexible strap 2702 with an integral internal permanently deformable structure 2794 which combine to create a semi rigid strap assembly 2796 for wearing directly onto a human's head in which aspects of the present invention may be realized. In FIG. 27, the flexible strap 2702 and the permanently deformable structure 2794 may be of a variety of lengths, shapes and sizes based on the user's requirements. The combination of these two items in conjunction permit this strap to be worn directly on the user's head without the requirement of any other headwear or headgear, although it still may be mounted inside various headgear or headwear. The external flexible strap 2702 and the permanently deformable structure 2794 may be straight, curved, angled, and/or formed to a variety of geometric shapes or positions for being secured directly onto the user's head or into an article of clothing. For example, the portions 2703 along the sides (which are illustrated in FIG. 27 by combining 2703 and 2706) may be a combination of concave, convex, or straight (shown in the FIG. 27 as a combination of profiles) whereas the width across the external flexible strap 2702 provides a location for the installation of a miniature MP3 player. The center portion 2706 may be also concave, convex, or form a variety of geometric shapes and sizes (shown in FIG. 27 as convex). In FIG. 27, the external flexible strap 2702 illustrates the center portion as having an elongated oval shape. The thickness, depth, and/or width of the semi rigid strap assembly 2796 may vary according to the type of activity it is being use on. For example, for a direct head mount or even for a baseball hat installation, the strap may be relatively thin (e.g., less than a millimeter in thickness) and for a motorcycle helmet the strap may be designed with a thicker dimension (e.g., 3 millimeters) for more stability and strength. However, the thickness may also be based upon user preferences and vary accordingly. The semi rigid strap assembly 2796 may be comprised of a variety of materials, such as a plastic substance, carbon fibers, polyurethane material, synthetic polymer material, cushioning material, fibrous materials, rubber materials, glass, elastic materials, flexible materials (e.g., a flexible membrane), cork, foam, metallic materials and/or other material or combination of materials known in the art, which are suitable for such an application. The external flexible strap 2702 may have an adhesive type material applied to any portion thereof and the adhesive material may include, but not limited to: tape, glue, buttons, clips, suction cups, Velcro®, a heat seal, reactive/non-reactive and/or natural synthetic type adhesives, and/or any type of substance known in the art that unites, bonds, secures, fastens, and/or sticks to the article of clothing or protective device for the head, in the event this is being used with an article of clothing or a protective device. For example, the semi rigid strap assembly 2796 may have a sticky, glue-like substance that is applied to an underneath portion for sticking the semi rigid strap assembly 2796 to a helmet. The semi rigid strap assembly 2796 has an ending 2707 that forms a right foot 2705*a* and a left foot 2705*b*. The end portions 2707 may be concave thereby having the end points 2705 of the right foot 2705*a* and the left foot 2705*b* extends to a rounded point. FIG. 27 illustrates the right foot 2705*a* and the left foot 2705*b* having a cutout 2709 which allows the right and left speakers to be fed through said cutouts. Integral to each cutout 2709 profile is a slit 2792 which allows the speaker wire to become wedged into place. A channel 2770 is created by top protrusion 2772*a* and bottom protrusion 2772*b* which provides an open cavity for the speaker wires to stay secured once tension is set by wedging the right speaker wire and left speaker wire into slits 2792. Both the right foot 2707*a* and the left foot 2707*b* may be manipulated within an article of clothing for securing, hiding, providing stability and support, and attaching the semi rigid strap assembly 2796 to the article of clothing (e.g., a baseball cap, helmet, and/or visor). The semi rigid strap assembly 2796 may also be adjusted so that it fits tightly on the user's head, thus eliminating the need for an article of clothing. The right foot 2707*a* and the left foot 2707*b* of semi rigid strap assembly 2796 operate as a stabilizing foot and/or end piece for placement in an interior structure of the article of clothing or stabilization and compression if not used with an article of clothing.

Moreover, the semi rigid strap assembly 2796 also includes slots 2718 (e.g., circular openings/groves that are illustrated in FIG. 27 as 2718*a* and 2718*b*) for receiving magnets. The magnets included in the slots 2718 allow for earphone speakers/headphone speakers to be secured to the magnets when not in use in a person's ear. In FIG. 27, the magnet cavity 2718 is illustrated with two circular shapes for receiving the magnets. These slots 2718 may also be covered with slits or molded seals (not shown) for securing the magnets to the semi rigid strap assembly 2796.

Figure 28:
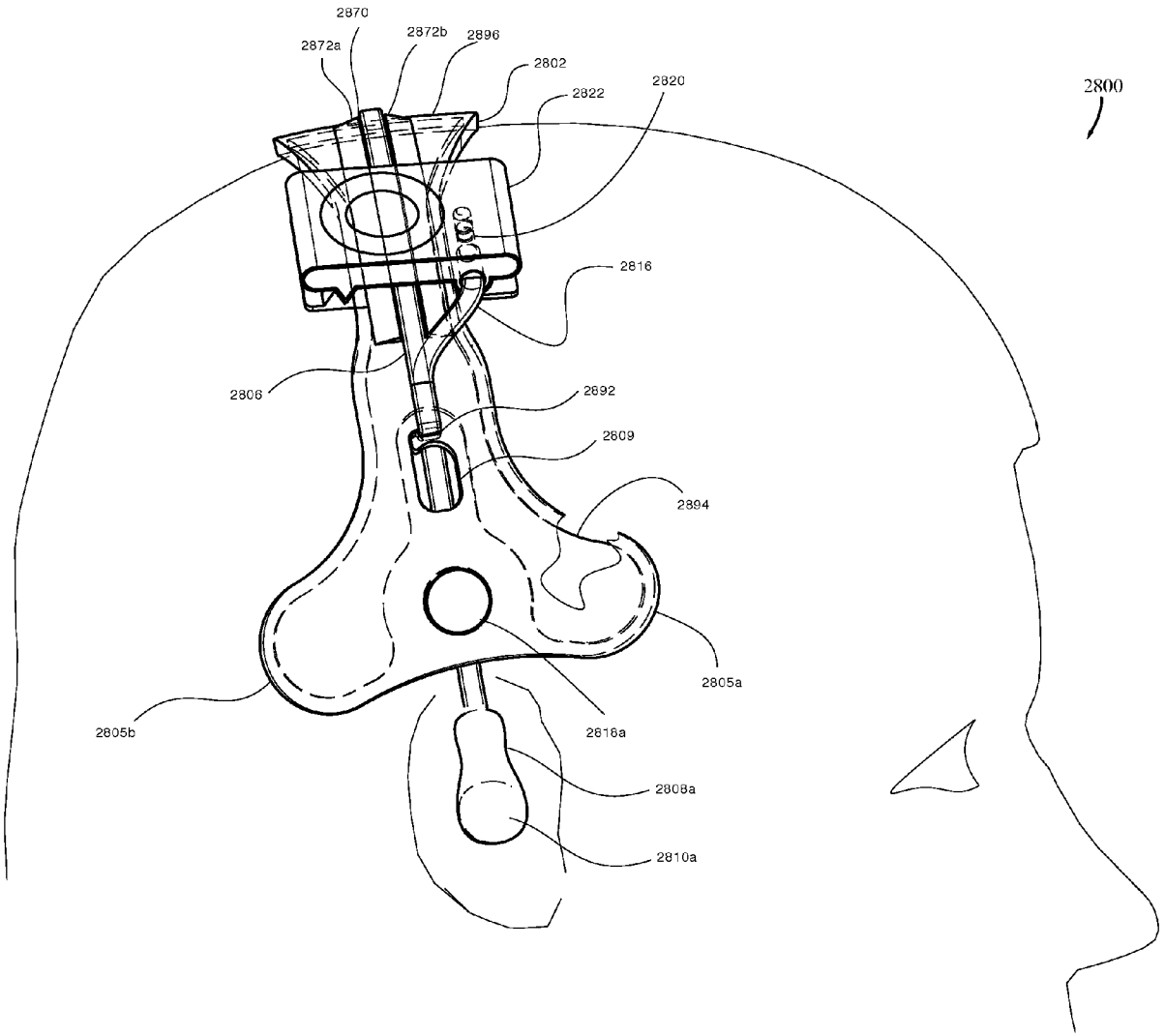
FIG. 28 is a diagram illustrating an exemplary listening device aid being worn directly onto a human's head with earphone speakers installed in human ears in which aspects of the present invention may be realized.

FIG. 28 is a diagram illustrating an exemplary listening device with a semi-rigid strap device 2800 aid being worn directly onto a human head with earphone speakers installed in human ears in which aspects of the present invention may be realized. FIG. 28 illustrates a side view depicting this configuration installed on a human head. In FIG. 28, an external flexible strap 2802 with an integral internal permanently deformable structure 2894 combine to create the semi rigid strap assembly 2896. The semi rigid strap assembly 2896 may then be worn directly on a human head without requiring the assistance of an article of clothing. In FIG. 28, the semi rigid strap assembly 2896 has an ending that forms a right foot 2805*a* and a left foot 2805*b*. The end portion of each of the right foot 2805*a* and the left foot 2805*b* may be rounded, semi-circular end points of the semi rigid strap assembly 2896. Both the right foot 2707*a* and the left foot 2707*b* may be manipulated within an article of clothing for securing, hiding, providing stability and support, and attaching the semi rigid strap assembly 2796 to the article of clothing (e.g., a baseball cap, helmet, and/or visor). The semi rigid strap assembly 2796 may also be adjusted so that it fits tightly on the user's head, thus eliminating the need for an article of clothing. The right foot 2707*a* and the left foot 2707*b* of semi rigid strap assembly 2796 operate as a stabilizing foot and/or end piece for placement in an interior structure of the article of clothing or stabilization and compression if not used with an article of clothing. Such a design of the semi rigid strap assembly 2896 allows for the even the use of wireless communication devices. For example, a user may use their own earphone cords and even use Bluetooth speaker wires designed to run around the back of a person's neck.

A first earphone body 2810*a* is connected to the first headphone cord 2816 for converting the sound signals to audible sounds. A second earphone body (not shown) is connected to a second headphone cord 2806 for converting the sound signals to audible sounds. The first earphone body 2810*a* and the second earphone body (not shown) are shaped to be retained in one of a concha cavity of a human car and the article of clothing. The first headphone cord 2816 is coupled to the first earphone body 2810*a* with an attachment point 2808*a* such that the first earphone body 2810*a* is lower than the attachment point 2808*a*. The first headphone cord 2816 is also connected to the audio/media device 2822. As illustrated in FIG. 28, the first earphone body 2810*a* and the second earphone body (not shown) are placed and inserted into the user's ear.

Moreover, the right foot 2805*a* and the left foot (not shown) contain a cutout 2809 which allows the right and left speakers to be fed through said cutouts. Integral to each cutout 2809 profile is a slit 2892 which allows the speaker wire to become wedged into place. A channel 2870 is created by left protrusion 2872*a* and right protrusion 2872*b* which provides an open cavity for the speaker wires to stay secured once tension is set by wedging the right speaker wire and left speaker wire into slits 2892. The channel structure 2870 provides a secure cavity for retaining the earphone cord while preventing the earphone cords from sliding out of the channel structure 2870 in the semi rigid strap assembly 2896. The semi rigid strap assembly 2896 also includes slots (e.g., circular openings/groves and shown in FIG. 28 as right hand slot 2818*a* and left hand slot (not shown) for receiving magnets. The magnets included in the slots 2818 allow for earphone speakers/headphone speakers to be secured by the magnets when not in use in a person's ear. In FIG. 28, the right hand magnet cavity 2818*a* is illustrated as a circle. The first headphone cord 2816 is also connected to the audio/media device 2822 via earphone plug 2820. The audio/media device 2822 is connected directly to the semi rigid strap assembly 2896 as illustrated in FIG. 28.

While one or more embodiments of the present invention have been illustrated in detail, the skilled artisan will appreciate that modifications and adaptations to those embodiments may be made without departing from the scope of the present invention as set forth in the following claims.

What is claimed is:

1. An earphone, comprising:

an earphone plug for receiving sound signals;

a first headphone cord connected to the earphone plug having a first length;

a second headphone cord connected to the earphone plug having a second length;

a first earphone body connected to the first headphone cord for converting the sound signals to audible sounds;

a second earphone body connected to the second headphone cord for converting the sound signals to audible sounds;

an attachment mechanism coupled to at least a portion of the first headphone cord or the second headphone cord for securing the earphone to an article of clothing to be worn on a head; and a flexible strap removably coupled with one of at least a portion of the first headphone cord and the second headphone cord, the flexible strap bendable into a curve and having opposing ends, each end including a foot extending therefrom for insertion into an interior structure of the article of clothing and for securement therein.

2. The earphone of claim 1, wherein the first earphone body and the second earphone body are shaped to be retained in one of a concha cavity of a human ear and the article of clothing.

3. The earphone of claim 1, wherein the first earphone body and the second earphone body are shaped to surround and cover a human ear.

4. The earphone of claim 1, wherein the first length of the a first headphone cord is greater than the second length of the second headphone cord.

5. The earphone of claim 1, further including:

at least one hooking mechanism coupled to at least a portion of the first headphone cord for securing the first headphone cord to one of an alternative one of the at least one hooking mechanism and an article of clothing.

6. The earphone of claim 1, wherein the flexible strap is coupled to at least a portion of the attachment mechanism.

7. The earphone of claim 1, further including connecting the first length of the first headphone cord with the flexible strap.

8. The earphone of claim 1, wherein the first headphone cord is coupled to the first earphone body with an attachment point such that the headphone body is lower than the attachment point.

9. The earphone of claim 1, further including a hanging device coupled to one of the first earphone body and the second earphone body for attaching to a human ear.

10. The earphone of claim 1, further including wherein the first earphone body and the second earphone body have at least a portion of an electronic circuit integrated therein for wireless communication with a host device.

11. A method of manufacturing an earphone, comprising:

providing an earphone plug for receiving sound signals;

providing a first headphone cord connected to the earphone plug having a first length;

providing a second headphone cord connected to the earphone plug having a second length;

providing a first earphone body connected to the first headphone cord for converting the sound signals to audible sounds;

providing a second earphone body connected to the second headphone cord for converting the sound signals to audible sounds;

providing an attachment mechanism coupled to at least a portion of the first headphone cord or the second headphone cord for securing the earphone to an article of clothing to be worn on a head; and providing a flexible strap removably coupleable with one of at least a portion of the first headphone cord and the second headphone cord, the flexible strap bendable into a curve and having opposing ends, each end including a foot extending therefrom for insertion into an interior structure of the article of clothing and for securement therein.

12. The method of manufacturing the earphone of claim 11, wherein the first earphone body and the second earphone body are shaped to be retained in one of a concha cavity of a human ear and the article of clothing.

13. The method of manufacturing the earphone of claim 11, wherein the first earphone body and the second earphone body are shaped to surround and cover a human ear.

14. The method of manufacturing the earphone of claim 11, wherein the first length of the first headphone cord is greater than the second length of the second headphone cord.

15. The method of manufacturing the earphone of claim 11, further including: providing at least one hooking mechanism coupled to at least a portion of the first headphone cord for securing the first headphone cord to one of an alternative one of the at least one hooking mechanism and an article of clothing.

16. The method of manufacturing the earphone of claim 11, further including providing the flexible strap coupled to at least a portion of the attachment mechanism.

17. The method of manufacturing the earphone of claim 11, further including providing the first length of the a first headphone cord for being connected with the flexible strap.

18. The method of manufacturing the earphone of claim 11, wherein the first headphone cord is coupled to the first earphone body with an attachment point such that the headphone body is lower than the attachment point.

19. The method of manufacturing the earphone of claim 11, further including providing a hanging device coupled to one of the first earphone body and the second earphone body for attaching to a human ear.

20. The method of manufacturing the earphone of claim 11, wherein the first earphone body and the second earphone body has at least a portion of an electronic circuit integrated therein for wireless communication with a host device.

* * * * *